US006631973B1

(12) United States Patent
Edamura

(10) Patent No.: US 6,631,973 B1
(45) Date of Patent: Oct. 14, 2003

(54) SUCTION RECOVERY METHOD AND INK JET PRINTING APPARATUS

(75) Inventor: Tetsuya Edamura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/639,081

(22) Filed: Aug. 16, 2000

(30) Foreign Application Priority Data

Aug. 24, 1999 (JP) ..... 11-236449

(51) Int. Cl.[7] ..... B41J 2/165
(52) U.S. Cl. ..... 347/30; 347/23; 347/29
(58) Field of Search ..... 347/30, 29, 22, 347/32, 35, 23

(56) References Cited

U.S. PATENT DOCUMENTS 4,893,138 A 1/1990 Terasawa et al. ..... 347/30
6,036,299 A * 3/2000 Kobayashi et al. ..... 347/30

FOREIGN PATENT DOCUMENTS

| | | |
|---|---|---|
| EP | 0 541 519 | 5/1993 |
| EP | 0 592 006 A1 * | 4/1994 |
| EP | 0 670 223 | 9/1995 |
| EP | 0 765 751 | 4/1997 |

OTHER PUBLICATIONS

European Search Report, EP 00118073, De Groot, R. Apr. 25, 2001.

* cited by examiner

*Primary Examiner*—Shih-Wen Hsieh
(74) *Attorney, Agent, or Firm*—Fitzpatrick, Cella, Harper & Scinto

(57) ABSTRACT

A tube pump is continuously driven to set an interior of a cap at a target negative pressure, and then driving and stopping of the tube pump is repeated to maintain a predetermined suction pressure. Therefore, a suction operation can be performed without mixing bubbles in a liquid chamber or wasting inks.

8 Claims, 30 Drawing Sheets

SUCTION RECOVERY METHOD AND INK JET PRINTING APPARATUS

This application is based on Patent Application No. 11-236449 (1999) filed Aug. 24, 1999 in Japan, the content of which is incorporated hereinto by reference.

BACKGROUND OF THE INVENTION

1. Field of the Invention

The present invention relates to a suction recovery method and an ink jet printing apparatus. The present invention is applicable to general printing apparatuses, apparatuses such as copiers, facsimile terminal equipment having a communication system, and word processors having a printing section, as well as industrial printing apparatuses combined with various processing apparatuses in a compound manner.

2. Description of the Prior Art

In ink jet printers, when volatile components of an ink evaporate from a tip of a nozzle of an ink jet print head, the ink becomes more viscous, the concentration of an ink dye increases, or the ink is fixed. In addition, when the ink is left in the print head, bubbles may occur in a liquid chamber of the print head. The bubbles prevent the ink from being normally supplied, and in the worst case, the ink is totally precluded from flowing through the print head, thereby seriously affecting printing operations.

To avoid this problem, a suction recovery method is widely used which caps a face of the print head while using a pump previously provided in the printer to reduce pressure inside the cap in order to draw out the ink from the nozzle.

Pumps used for this suction recovery can be roughly classified into piston pumps and tube pumps.

A method with a piston pump comprises moving a piston of the piston pump to reduce the pressure of a vacuum chamber 10 in communication with the cap and then allowing the vacuum chamber 10 and the interior of the cap to communicate with each other, as shown in FIG. 25. As a result, a negative pressure is generated inside the cap as shown in FIG. 26. As is apparent from this figure, the method with the piston pump enables a high negative pressure to be instantaneously applied to the print head. The negative pressure disappears as the ink flows into the cap.

A method with a tube pump comprises generating a negative pressure inside the cap using a recovery force of a tube 21, which has been squeezed by a roller 20, as shown in FIG. 27. The tube pump enables the amount of suction to be arbitrarily set by varying the amount of squeezing and also enables suction pressure to be arbitrarily set by varying squeezing speed. This method, however, increases the negative pressure while sucking the ink, the ink is wasted until a desired suction pressure is reached. In addition, to increase the suction pressure quickly, the squeezing speed must be augmented, thereby requiring a strong driving force.

FIG. 28 shows temporal variations in negative pressure observed when the tube pump is used for suction. This figure shows that in an area A, the suction pressure (negative pressure) increases consistently with time, whereas in an area B, the balance is held between the negative pressure generated by the pump and cancellation of the negative pressure effected by the drawn-out ink, resulting in a balanced state. The negative pressure in the balanced state (a saturated pressure) depends on flow resistance of the head during the suction and on the capabilities of the pump. Typically, a suction recovery operation is performed in the area A.

Unlike the tube pump, the piston pump does not enable suction conditions (the suction pressure and the amount of suction) to be arbitrarily set by means of control during operation. Additionally, due to the instantaneously high negative pressure, ink flow speed may increase excessively during suction. If the ink is likely to generate a large amount of bubbles, the method with the piston pump causes bubbles to be generated in the head during the suction, resulting in a trouble.

Consequently, if the suction conditions are to be set precisely or the printer uses an ink that is likely to generate a large amount of bubbles, the tube pump is often used.

Precisely speaking, the suction recovery performance should be set using the ink flow speed and the flow rate measured at this speed. The ink flow speed, however, varies over time, and it is thus difficult to measure this speed to quantitatively set the suction recovery performance. As a result, the suction recovery performance is typically controlled based on the suction pressure and the amount of suction.

The method with the tube pump, however, has problems originating from a continuous increase in suction pressure during the ink suction.

That is, since the amount of suction and the suction pressure cannot be set independently, the ink may be wasted and bubbles may be mixed in the liquid chamber.

For example, in a system where the suction pressure is likely to rise, that is, a system where the suction pressure increases as shown by a steep curve, the suction pressure rises excessively in order to maintain the amount of suction. The excessive increase in suction pressure causes an increase in ink flow speed. The ink supply capacity of an ink tank per unit time has an upper limit, so that at a flow rate higher than this upper limit, the ink is inappropriately supplied to cause bubbles to be mixed in the liquid chamber.

On the other hand, in a system where the suction pressure is unlikely to rise, that is, a system where the suction pressure increases as shown by a gentle curve, an excess amount of ink must be sucked in order to maintain the suction pressure. This causes the ink to be wasted.

To avoid these problems, the tube pump configuration must be determined in such a manner that the suction pressure and the amount of suction correspond mutually. This, however, lessens the advantage of the tube pump of being able to arbitrarily determine recovery conditions.

Furthermore, for an ink jet apparatus having a function for using different recovery modes with step-by-step varying recovery performances for different situations, conditions being met for each of the recovery modes must be determined. It is thus very difficult to design such an ink jet apparatus.

The present invention is provided in view of these circumstances, and it is an object thereof to provide a suction recovery method and apparatus for ink jet printing apparatuses that can maintain, during suction recovery operations, a suction recovery performance while avoiding wasting inks and mixing bubbles in a liquid chamber.

SUMMARY OF THE INVENTION

To solve the above described problems, the present invention provides a suction recovery method for an ink jet printing apparatus for driving a tube pump connected to a cap while a face of a print head is capped by the cap, to generate a negative pressure inside the cap to suck an ink from the print head, the method being characterized by comprising a first step of continuously driving the tube pump to set an interior of the cap at a target negative pressure and a second step of stopping the tube pump and then driving it again.

In the second step, when a preset period of time has passed since the continuous driving of the tub pump was started, the interior of the cap can be exposed to the atmosphere. Alternatively, in the second step, stopping and driving of the tube pump can be repeated a number of times to carry out idle suction even after the interior of the cap has been exposed to the atmosphere. Alternatively, this method can further comprise a third step operating after the second step to stop the tube pump and then drive it again.

That is, according to the present invention, by repeating driving and stopping the pump during the suction, a predetermined suction pressure is maintained to enable a suction operation without excessively increasing the suction pressure. This is particularly effective on print heads with small ejection ports.

Thus, according to the present invention, the tube pump is continuously rotated to quickly set the interior of the cap at the target negative pressure, and the driving and stopping of the tube pump is then repeated a number of times to maintain the interior of the cap within a predetermined range near the target negative pressure. Consequently, the suction can be recovered with an appropriate amount of suction and an appropriate suction pressure for the print head to restrain the wasteful use of inks while preventing bubbles from being sucked. As a result, suction can be reliably recovered.

Alternatively, the present invention provides a suction recovery method for an ink jet printing apparatus for driving a tube pump connected to a cap while a face of a print head is capped by the cap, to generate a negative pressure inside the cap to suck an ink from the print head, the method being characterized by comprising a first step of continuously driving the tube pump at a first predetermined speed to set an interior of the cap at a target negative pressure and a second step of driving the tube pump at a second speed lower than the first speed.

In the second step, when a preset predetermined period of time has passed since the continuous driving of the tub pump was started, the interior of the cap can be exposed to the atmosphere. Alternatively, in the second step, the tube pump can be driven to carry out idle suction even after the interior of the cap has been exposed to the atmosphere.

Thus, according to the present invention, the tube pump is continuously rotated at a predetermined driving speed to quickly set the interior of the cap at the target negative pressure, and is then driven at a reduced driving speed to maintain the target negative pressure. Consequently, the suction pressure remains at the same level, and the suction can be recovered with an appropriate amount of suction and an appropriate suction pressure for the print head to restrain the wasteful use of inks while preventing bubbles from being sucked.

The above and other objects, effects, features and advantages of the present invention will become more apparent from the following description of embodiments thereof taken in conjunction with the accompanying drawings.

DESCRIPTION OF THE PREFERRED EMBODIMENTS

Embodiments of the printing apparatus according to the present invention will be described by referring to the accompanying drawings.

In this specification, a word "print" (or "record") refers to not only forming significant information, such as characters and figures, but also forming images, designs or patterns on printing medium and processing media, whether the information is significant or insignificant or whether it is visible so as to be perceived by humans.

The word "print medium" or "print sheet" include not only paper used in common printing apparatus, but cloth, plastic films, metal plates, glass, ceramics, wood, leather or any other material that can receive ink. This word will be also referred to "paper".

Further, the word "ink" (or "liquid") should be interpreted in its wide sense as with the word "print" and refers to liquid that is applied to the printing medium to form images, designs or patterns, process the printing medium or process ink (for example, coagulate or make insoluble a colorant in the ink applied to the printing medium).

In the following description we take up as an example a printing apparatus using an ink jet printing system.

I. FUNDAMENTAL CONSTRUCTION

By referring to FIGS. 1 to 18 a fundamental construction of a printer will be described.

I.1 Apparatus Body

Figure 1:
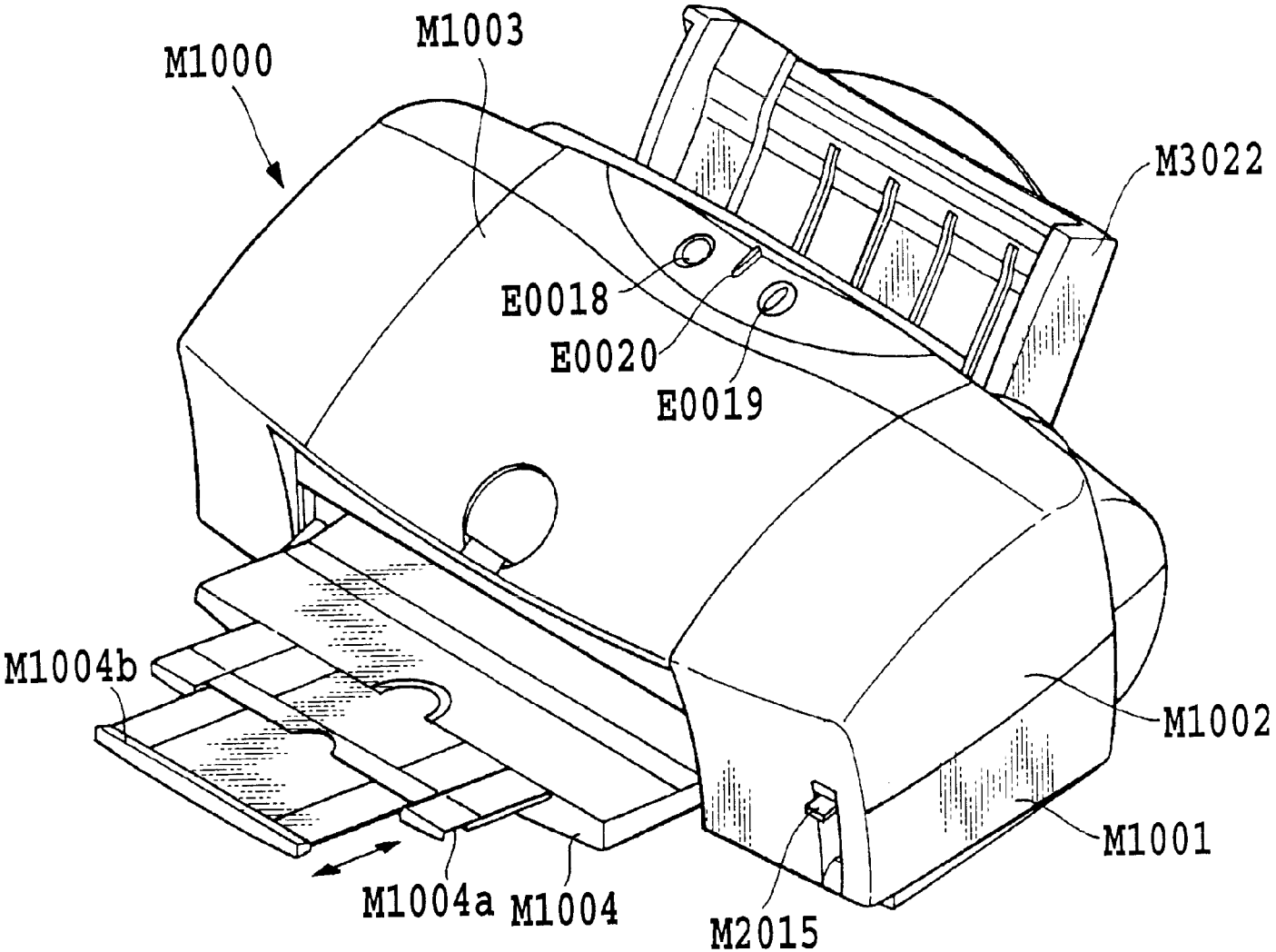
FIG. 1 is a perspective view showing an external construction of an ink jet printer as one embodiment of the present invention.
Figure 2:
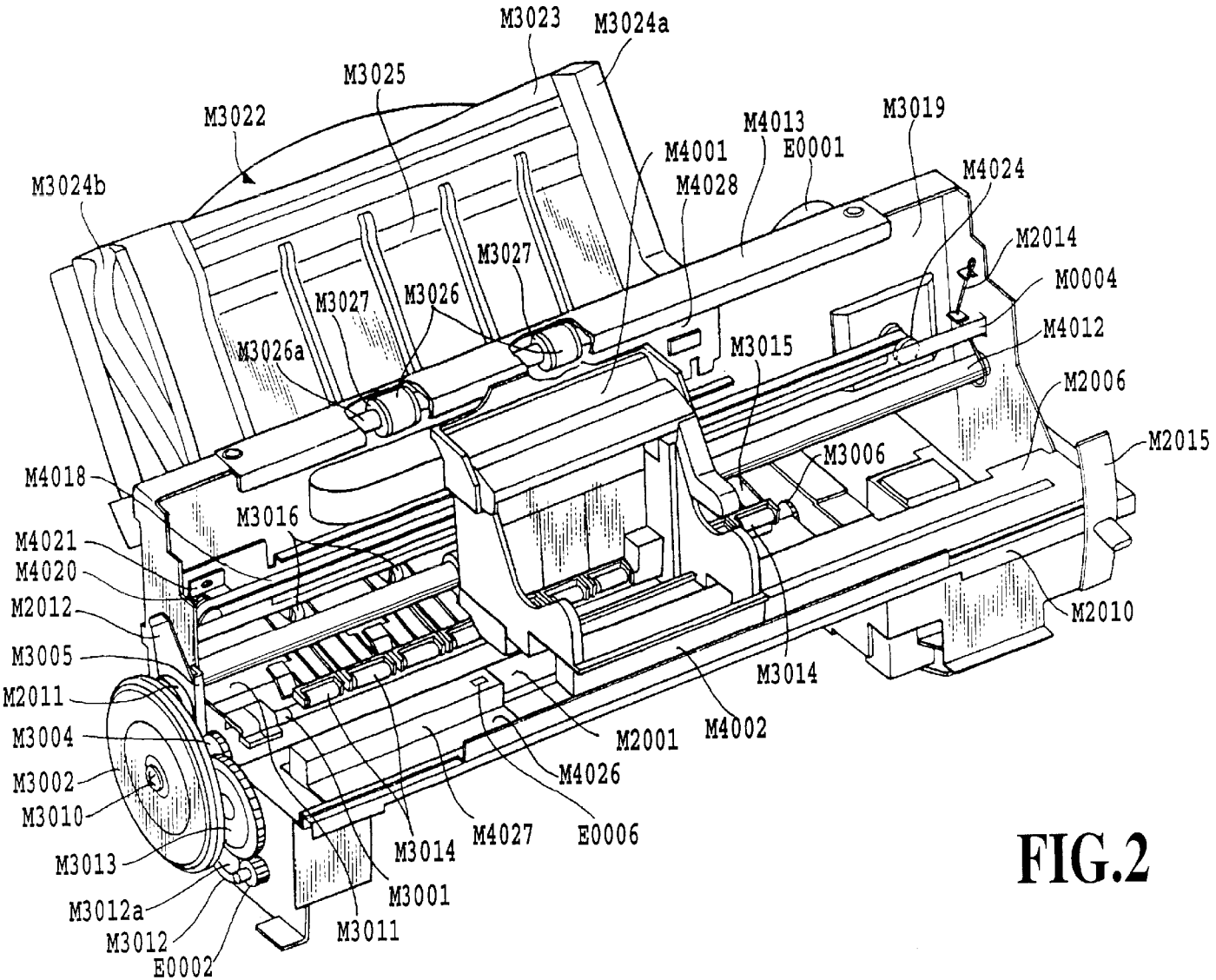
FIG. 2 is a perspective view showing the printer of FIG. 1 with an enclosure member removed.

FIGS. 1 and 2 show an outline construction of a printer using an ink jet printing system. In FIG. 1, a housing of a printer body M1000 of this embodiment has an enclosure member, including a lower case M1001, an upper case M1002, an access cover M1003 and a discharge tray M1004, and a chassis M3019 (see FIG. 2) accommodated in the enclosure member.

The chassis M3019 is made of a plurality of plate-like metal members with a predetermined rigidity to form a skeleton of the printing apparatus and holds various printing operation mechanisms described later.

The lower case M1001 forms roughly a lower half of the housing of the printer body M1000 and the upper case M1002 forms roughly an upper half of the printer body M1000. These upper and lower cases, when combined, form a hollow structure having an accommodation space therein to accommodate various mechanisms described later. The printer body M1000 has an opening in its top portion and front portion.

The discharge tray M1004 has one end portion thereof rotatably supported on the lower case M1001. The discharge tray M1004, when rotated, opens or closes an opening formed in the front portion of the lower case M1001. When the print operation is to be performed, the discharge tray M1004 is rotated forwardly to open the opening so that printed sheets can be discharged and successively stacked. The discharge tray M1004 accommodates two auxiliary trays M1004*a*, M1004*b*. These auxiliary trays can be drawn out forwardly as required to expand or reduce the paper support area in three steps.

The access cover M1003 has one end portion thereof rotatably supported on the upper case M1002 and opens or closes an opening formed in the upper surface of the upper case M1002. By opening the access cover M1003, a print head cartridge H1000 or an ink tank H1900 installed in the body can be replaced. When the access cover M1003 is opened or closed, a projection formed at the back of the access cover, not shown here, pivots a cover open/close lever. Detecting the pivotal position of the lever as by a micro-switch and so on can determine whether the access cover is open or closed.

At the upper rear surface of the upper case M1002 a power key E0018, a resume key E0019 and an LED E0020 are provided. When the power key E0018 is pressed, the LED E0020 lights up indicating to an operator that the apparatus is ready to print. The LED E0020 has a variety of display functions, such as alerting the operator to printer troubles as by changing its blinking intervals and color. Further, a buzzer E0021 (FIG. 15) may be sounded. When the trouble is eliminated, the resume key E0019 is pressed to resume the printing.

I.2 Printing Operation Mechanism

Next, a printing operation mechanism installed and held in the printer body M1000 according to this embodiment will be explained.

The printing operation mechanism in this embodiment comprises: an automatic sheet feed unit M3022 to automatically feed a print sheet into the printer body; a sheet transport unit M3029 to guide the print sheets, fed one at a time from the automatic sheet feed unit, to a predetermined print position and to guide the print sheet from the print position to a discharge unit M3030; a print unit M4000 to perform a desired printing on the print sheet carried to the print position; and an ejection performance recovery unit M5000 to recover the ink ejection performance of the print unit M4000.

Next, the construction of each mechanism will be explained.

I.2.1 Automatic Sheet Feed Unit

By referring to FIGS. 2 and 3 the automatic sheet feed unit M3022 will be described.

The automatic sheet feed unit M3022 in this embodiment horizontally feeds one of print sheets stacked at an angle of about 30–60 degrees to the horizontal plane, so that the sheet is discharged out of a sheet feed port not shown into the printer body while being kept in an almost horizontal attitude.

The automatic sheet feed unit M3022 includes feed rollers M3026, sheet guides M3024*a*, M3024*b*, a pressure plate M3025, an ASF base M3023, sheet separators M3027, and separation claws not shown. The ASF base M3023 forms a housing of the automatic sheet feed unit M3022 and is provided at the back of the printer body. On the front side of the ASF the pressure plate M3025 supporting the print sheets is mounted at an angle of about 30–60 degrees to the horizontal plane and a pair of sheet guides M3024*a*, M3024*b* that guide the ends of the print sheets project forwardly. One of the sheet guides M3024*b* is movable in the sheet width direction to conform to the horizontal size (width) of the sheets.

Rotatably supported on the left and right sides of the ASF base M3023 is a drive shaft M3026*a* that is connected through a gear not shown to a PG motor and which has rigidly secured thereto a plurality of feed rollers M3026 semicircular in cross section.

Figure 15:
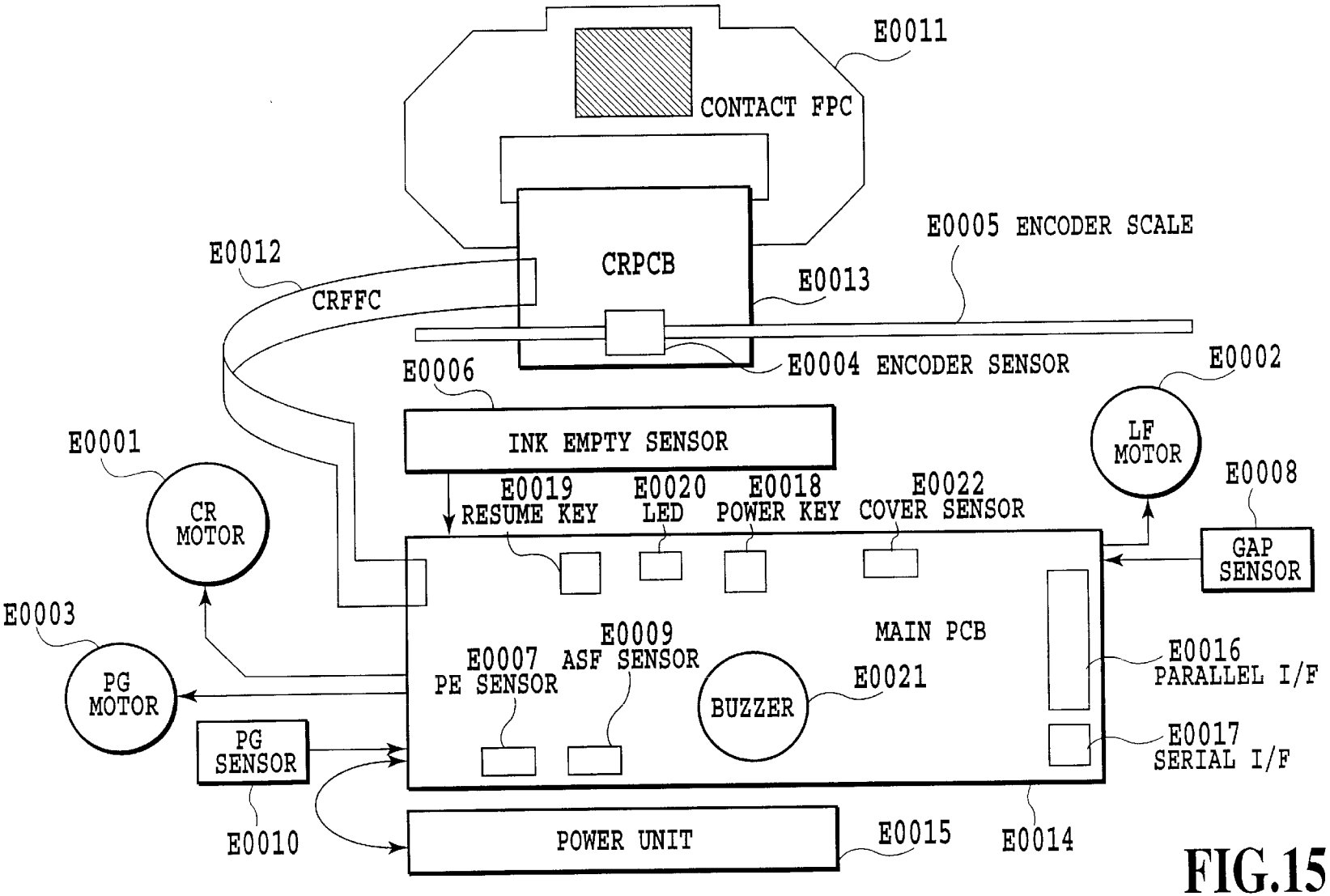
FIG. 15 is a block diagram schematically showing the overall configuration of an electric circuitry of the printer according to one embodiment of the present invention.

The print sheets stacked on the pressure plate M3025 are fed by the feed rollers M3026 that are driven by the PG motor E0003 (FIG. 15). The stacked sheets are separated one by one from the top of the stack by the sheet separators M3027 and the separation claws and forwarded to the paper transport unit M3029. The lower end of the pressure plate M3025 is resiliently supported by a pressure plate spring M3028 interposed between the pressure plate M3025 and the ASF base M3023, so that the contact force between the feed rollers and the sheet can be kept constant regardless of the number of sheets stacked.

Figure 3:
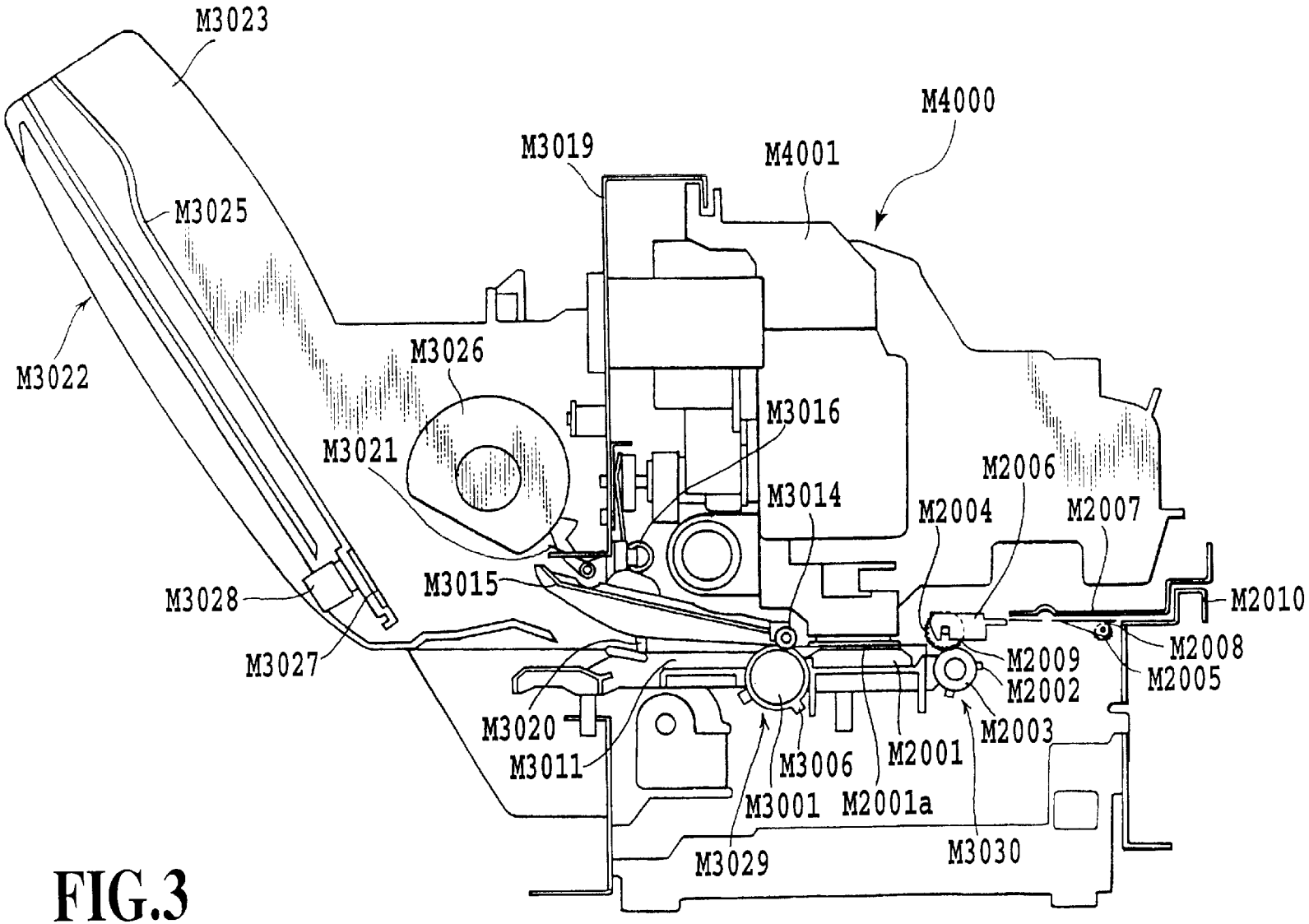
FIG. 3 is a side view of FIG. 2.

In a transport path from the automatic sheet feed unit M3022 to the paper transport unit M3029, a PE lever M3020 urged clockwise in FIG. 3 by a PE lever spring M3021 is pivotally mounted on a chassis M3019 which is secured to the printer body M1000 and formed of a metal plate member with a predetermined rigidity. When the print sheet separated and fed from the automatic sheet feed unit M3022 moves along the path and its front end abuts against one end of the PE lever and pivots it, a PE sensor not shown senses the rotation of the PE lever M3020, detecting that the print sheet has entered into the transport path.

After the entrance into the transport path of the print sheet has been detected, the print sheet is transported a predetermined distance downstream by the feed rollers M3026. That is, the print sheet is fed until its front end contacts a nip portion formed by an LF roller M3001, which is at rest and provided in the paper transport unit described later, and pinch rollers M3014 and the print sheet deflects about 3 mm in loop, at which time the sheet is stopped.

I.2.2 Paper Transport Unit

Figure 4:
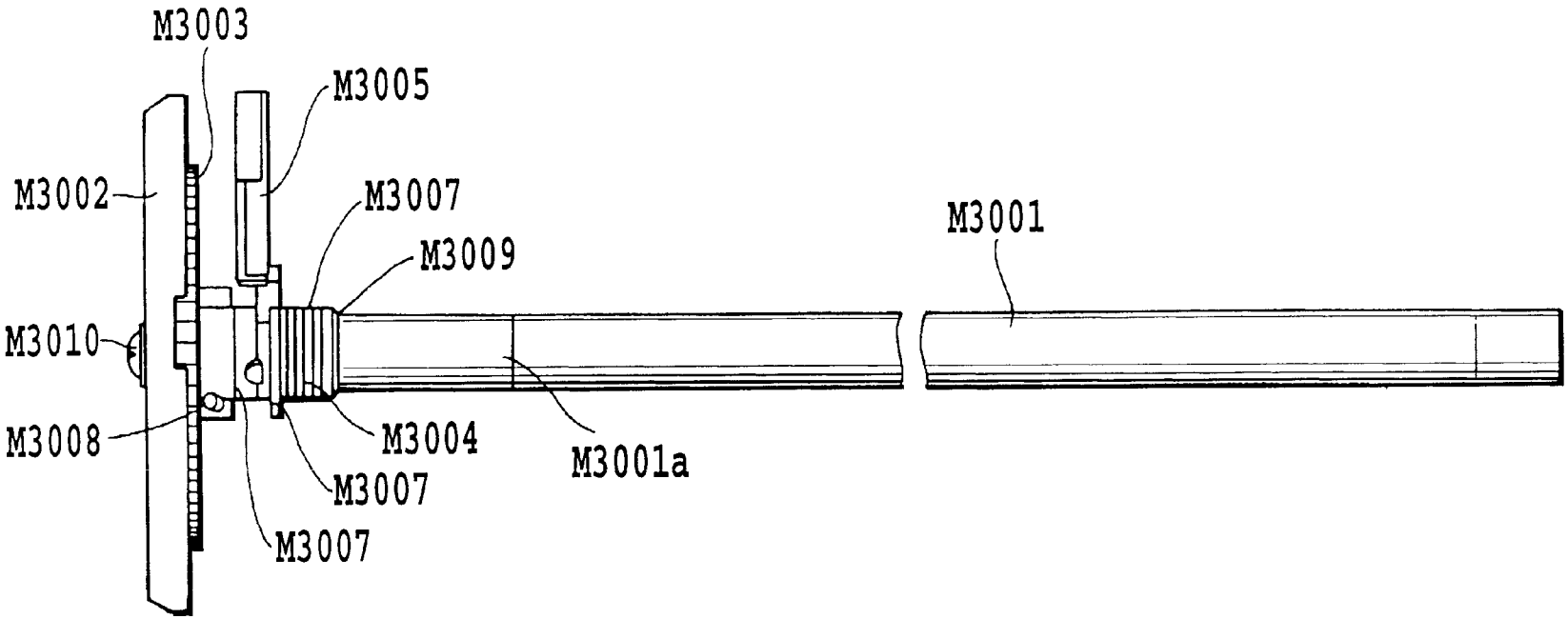
FIG. 4 is a front view showing a feed roller and an LF gear cover shown in FIG. 2.

The paper transport unit M3029 has an LF roller M3001, pinch rollers M3014 and a platen M2001. The LF roller M3001 is secured to a drive shaft rotatably supported on the chassis M3019 and, as shown in FIG. 4, has attached to one end thereof an LF gear cover M3002 that protects both an LF gear M3003 secured to the drive shaft M3001*a* and a small gear M3012*a* (see FIG. 2) of an LF intermediate gear M3012 in mesh with the LF gear M3003. The LF intermediate gear M3012 is interlocked with a drive gear of a drive shaft of an LF motor E0002 described later and is driven by the driving force of the motor.

The pinch rollers M3014 are rotatably mounted at the front end of pinch roller holders M3015 which is pivotally supported on the chassis M3019. The pinch rollers M3014 are pressed against the LF roller M3001 by spiral spring-like pinch roller springs M3016 that bias the pinch roller holders M3015. As a result, the pinch rollers M3014 rotate following the rotation of the LF roller M3001 to feed forwardly the print sheet, which was at rest in a looped state as described above, by gripping it between the pinch rollers M3014 and the LF roller M3001.

Figure 5:
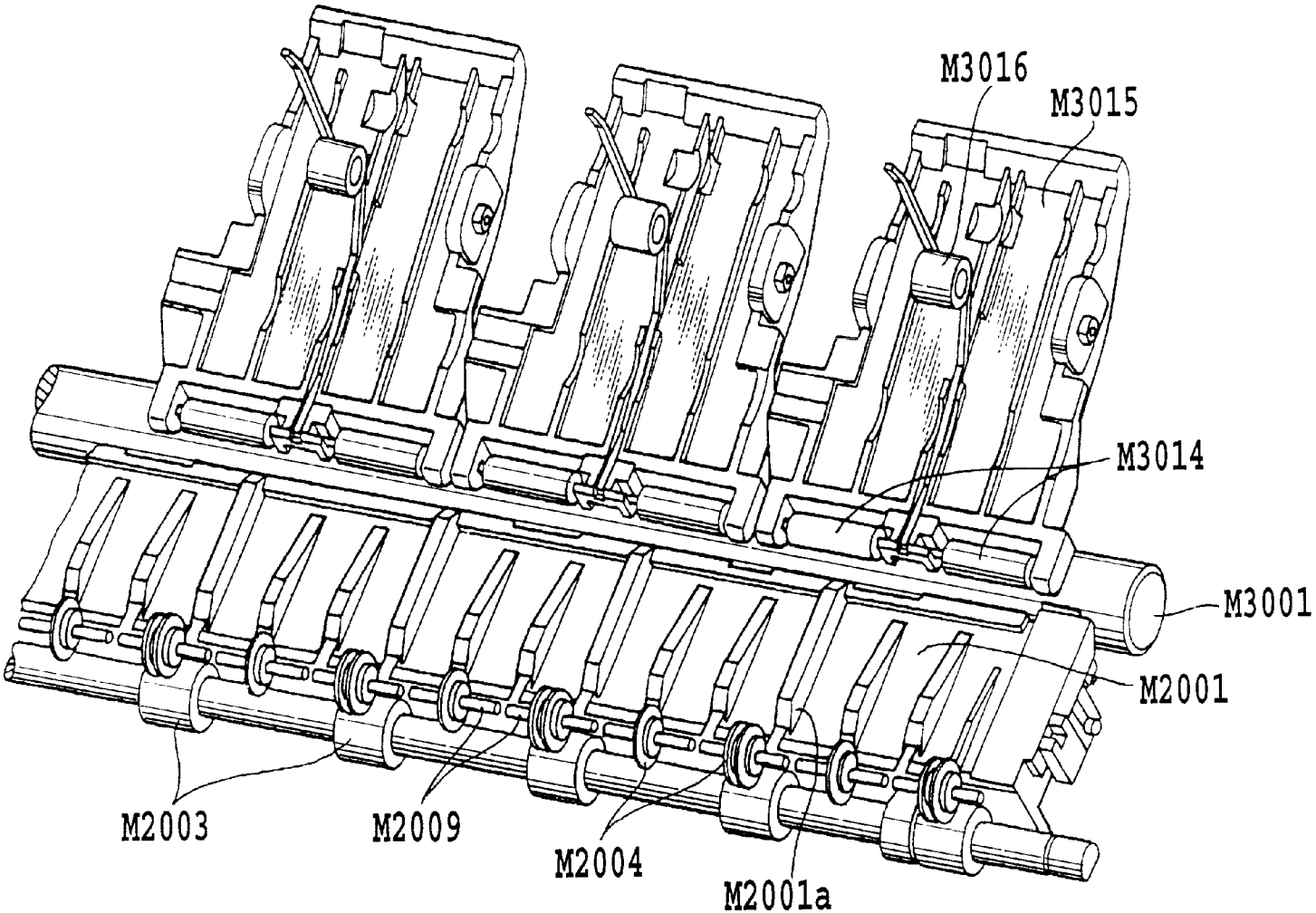
FIG. 5 is a perspective view showing pinch rollers and others shown in FIG. 2.

The rotation center of the pinch rollers M3014 is offset about 2 mm downstream of the rotation center of the LF roller M3001 in the direction of transport. Hence, the print sheet fed by the LF roller M3001 and the pinch rollers M3014 advances toward lower right in FIG. 3 along a print sheet support surface M2001*a* (FIG. 5).

A predetermined time after the feeding operation by the feed rollers M3026 of the automatic sheet feed unit M3022 has stopped, the paper transport unit constructed as described above starts the LF motor E0002. The driving force of the LF motor E0002 is transmitted via the LF intermediate gear M3012 and the LF gear M3003 to the LF roller M3001. As the LF roller M3001 rotates, the print sheet whose front end is in contact with the nip portion between the LF roller M3001 and the pinch rollers M3014 is carried to the print start position on the platen M2001.

At this time, the feed rollers M3026 resume rotating simultaneously with the LF roller M3001, so that the print sheet is transported downstream by the cooperation of the feed rollers M3026 and the LF roller M3001 for a predetermined period of time. A print head cartridge H1000 described later moves, mounted on a carriage M4001, along a carriage shaft M4012 secured at its ends to the chassis M3019, the carriage M4001 being adapted to reciprocate in a direction (scan direction) perpendicular to the direction in which the print sheet is fed. As it travels in the scan direction, the print head cartridge H1000 ejects ink, according to an image information, onto the print sheet held at the print start position to form an image.

After the image has been printed, the LF roller M3001 is rotated to feed the print sheet a predetermined distance at a time, which may correspond to one line height of, for example, 5.42 mm, followed by the carriage M4001 performing the main scan along the carriage shaft M4012. This process is repeated to complete an entire image on the print sheet placed on the platen M2001.

The carriage shaft M4012 has its one end mounted on an adjust plate (not shown) through an adjust lever 2015 and the other end mounted on another adjust plate M2012 through a carriage shaft cam M2011. The carriage shaft M4012 is biased by a carriage shaft spring M2014. The adjust plate M2012 and the other adjust plate not shown are secured to the chassis M3019 so that the distance between the ejecting face of the print head cartridge H1000 and the print sheet support surface M2001*a* of the platen M2001 can be adjusted to be an appropriate value.

Further, the adjust lever 2015 can be selectively set at one of two stop positions, an upper end position shown in FIG. 1 and a lower end position not shown. When the adjust lever 2015 is moved to the lower end position, the carriage M4001 is retracted about 0.6 mm from the platen M2001. Hence, if the print sheet is thick, as when an envelope is printed, the adjust lever 2015 is moved to the lower end position before the sheet feeding operation by the automatic sheet feed unit M3022 is started.

Figure 14:
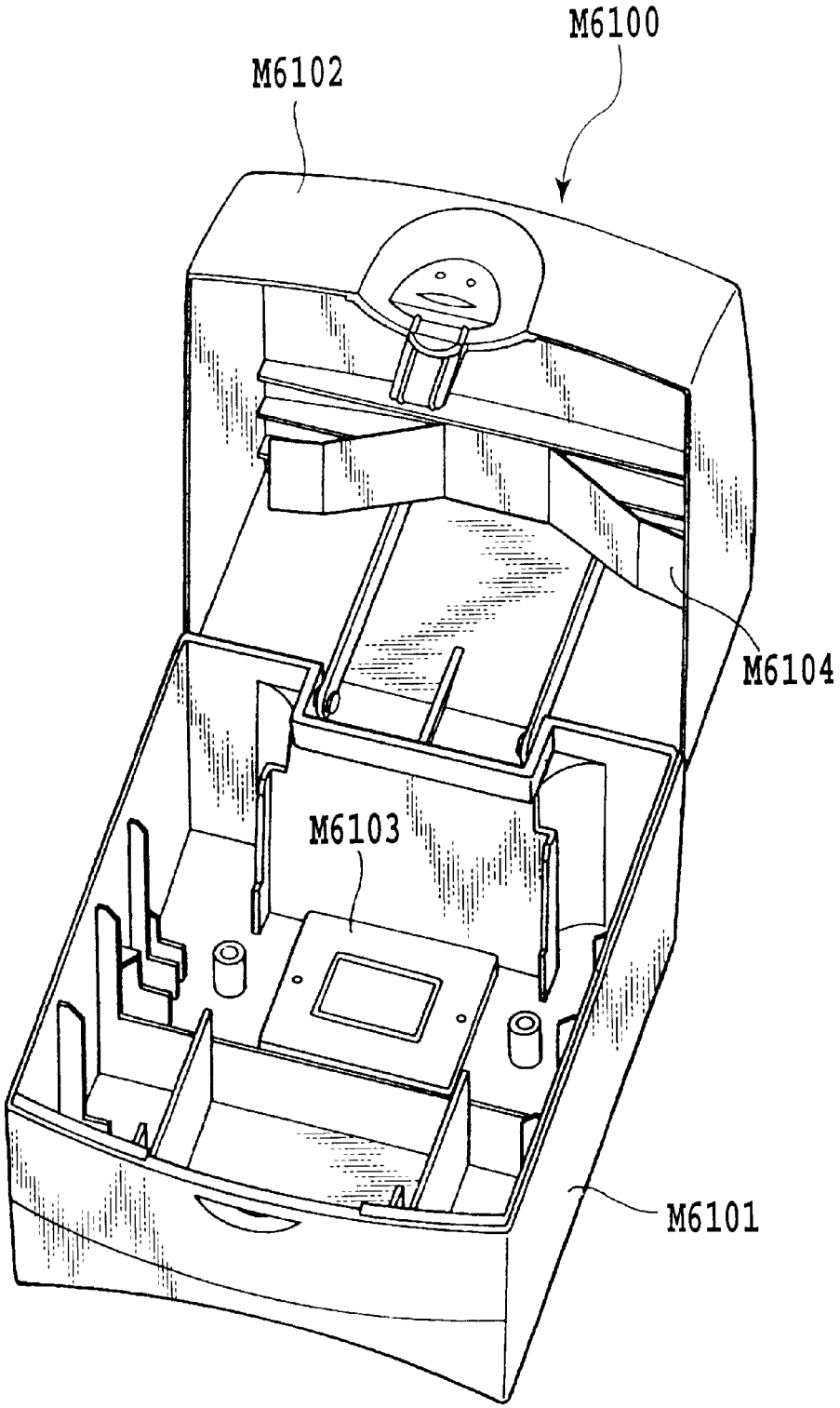
FIG. 14 is a perspective view showing a storage case in the embodiment of the invention.

When the adjust lever 2015 is located at the lower end position, this state is detected by the GAP sensor E0008 (see FIG. 14). Therefore, when the print sheet begins to be fed by the automatic sheet feed unit M3022, it is checked whether the position setting of the adjust lever 2015 is appropriate or not. When an inappropriate state is detected, a warning is issued by displaying a message or activating a buzzer to prevent the printing operation from being executed in an inappropriate condition.

I.3 Discharge Unit

Next, the discharge unit M3030 will be described by referring to FIGS. 2 and 3.

As shown in FIG. 3, the discharge unit M3030 has a discharge roller 2003; a discharge gear M3013 mounted on the discharge roller 2003 to transmit the driving force of the LF motor E0002 through the LF intermediate gear M3012 to the discharge roller 2003; a first spur M2004 rotated by the rotation of the discharge roller 2003 to grip the print sheet between it and the discharge roller 2003 to feed the sheet, and a discharge tray M1004 to aid in the discharge of the print sheet. The first spur M2004 is pressed against the discharge roller 2003 by a biasing force of a spur spring M2009 attached to a first spur holder M2006 mounted on a spur stay M2007.

The print sheet carried to the discharge unit M3030 is subjected to the transport force from the discharge roller 2003 and the first spur M2004. The rotation center of the first spur M2004 is offset about 2 mm upstream, in the transport direction, of the rotation center of the discharge roller 2003. Hence, the print sheet moved by the discharge roller 2003 and the first spur M2004 comes into light contact with the print sheet support surface M2001*a* of the platen M2001 with no gap between them and is therefore transported properly and smoothly.

The speed of the print sheet carried by the discharge roller 2003 and the first spur M2004 is almost equal to the speed of the sheet fed by the LF roller M3001 and the pinch roller M3014. To effectively prevent the print sheet from becoming slack, the speed at which the sheet is moved by the discharge roller 2003 and the first spur M2004 is set slightly higher.

Further, a second spur M2005 accommodated in a second spur holder M2008 is held on a part of the spur stay M2007 downstream of the first spur M2004 to prevent the print sheet from coming into a frictional, sliding contact with the spur stay M2007.

When the printing of an image on the print sheet is finished and the rear end of the print sheet comes off from between the LF roller M3001 and the pinch roller M3014, the print sheet is moved only by the discharge roller 2003 and the first spur M2004 until it is completely discharged.

I.4 Print Unit

Here, the print unit M4000 will be described. The print unit M4000 comprises a carriage M4001 movably supported on a carriage shaft M4021 and a print head cartridge H1000 removably mounted on the carriage M4001.

I.4.1 Print Head Cartridge

Figure 6:
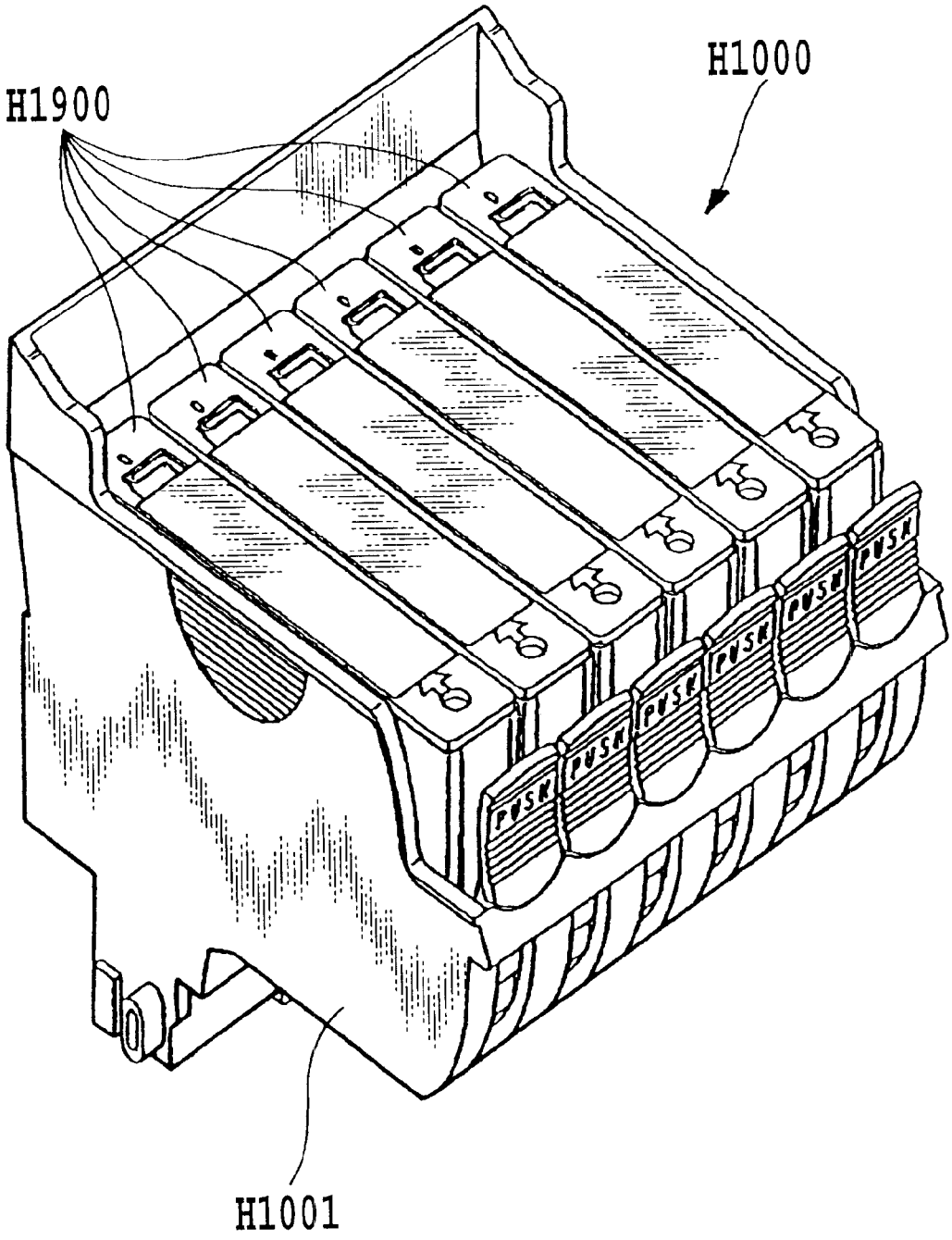
FIG. 6 is a perspective view showing an assembled print head cartridge used in the printer of one embodiment of the present invention.
Figure 7:
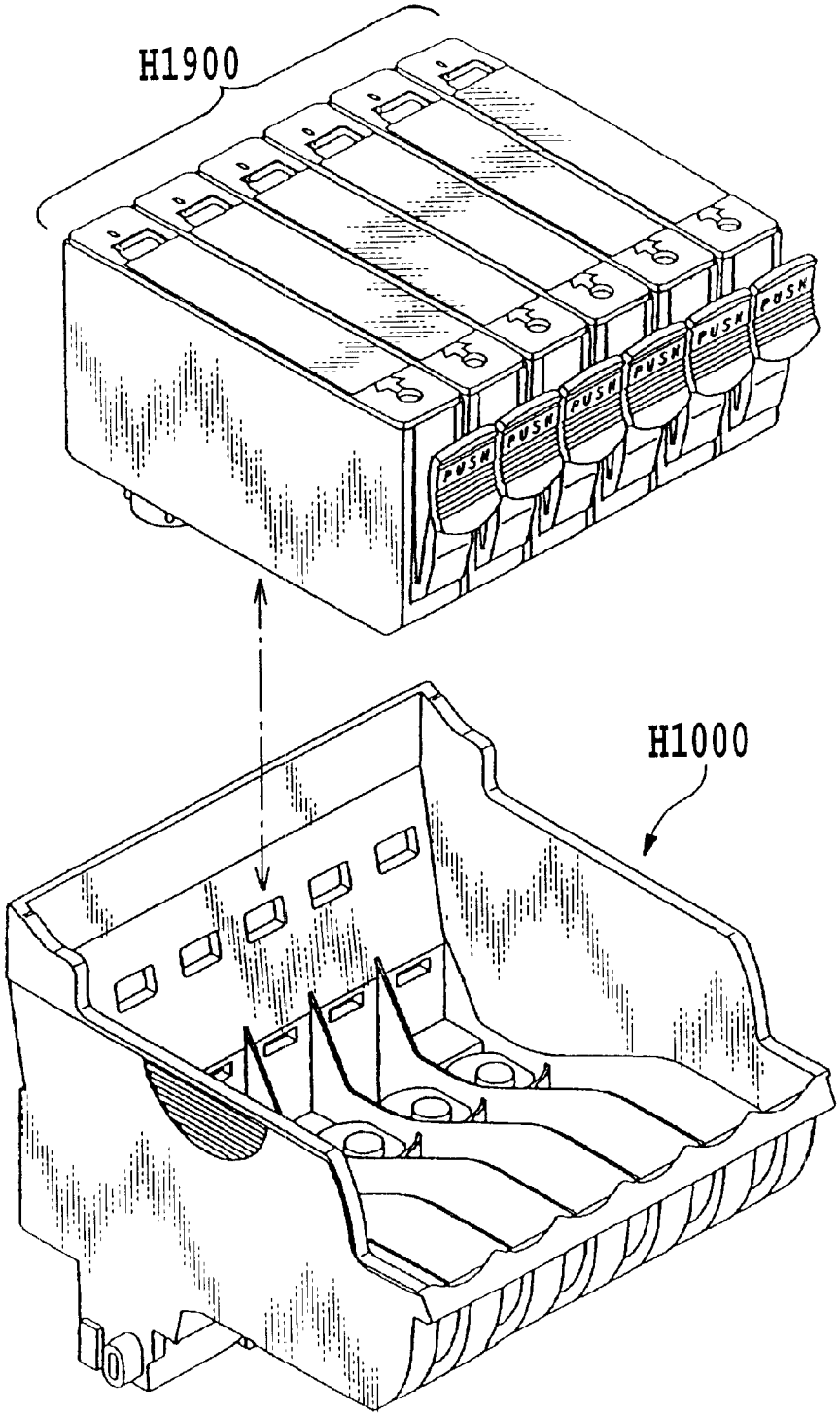
FIG. 7 is an exploded perspective view showing the print head cartridge of FIG. 6.
Figure 8:
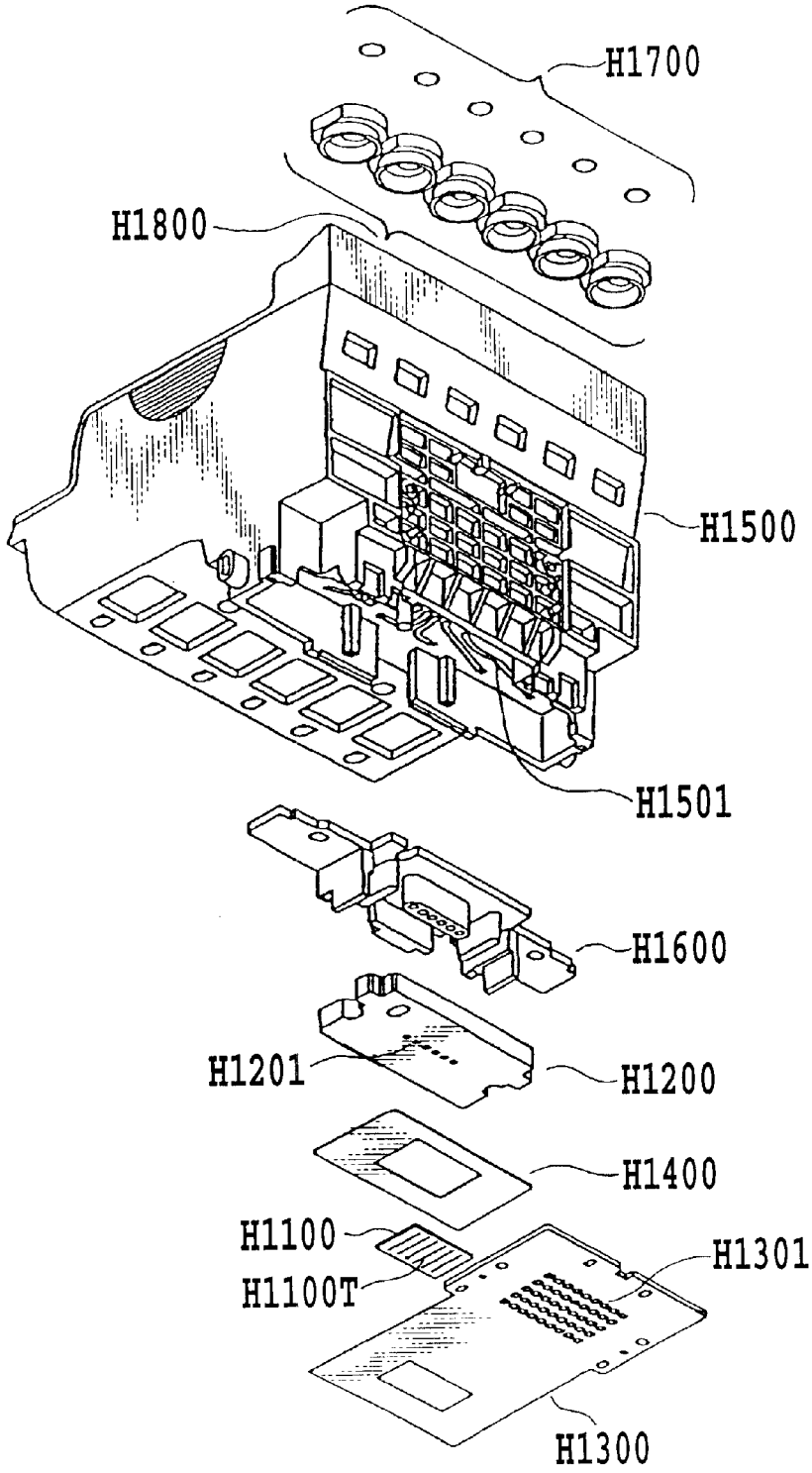
FIG. 8 is an exploded perspective view of the print head of FIG. 7 as seen from diagonally below.

First, the print head cartridge used in the print unit will be described with reference to FIGS. 6 to 8.

The print head cartridge H1000 in this embodiment, as shown in FIG. 3, has an ink tank H1900 containing inks and a print head H1001 for ejecting ink supplied from the ink tank H1900 out through nozzles according to print information. The print head H1001 is of a so-called cartridge type in which it is removably mounted to the carriage M4001 described later.

The ink tank for this print head cartridge H1000 consists of separate ink tanks H1900 of, for example, black, light cyan, light magenta, cyan, magenta and yellow to enable color printing with as high an image quality as photograph. As shown in FIG. 4, these individual ink tanks are removably mounted to the print head H1001.

Then, the print head H1001, as shown in the perspective view of FIG. 5, comprises a print element substrate H1100, a first plate H1200, an electric wiring board H1300, a second plate H1400, a tank holder H1500, a flow passage forming member H1600, a filter H1700 and a seal rubber H1800.

The print element silicon substrate H1100 has formed in one of its surfaces, by the film deposition technology, a plurality of print elements to produce energy for ejecting ink and electric wires, such as aluminum, for supplying electricity to individual print elements. A plurality of ink passages and a plurality of nozzles H1100T, both corresponding to the print elements, are also formed by the photolithography technology. In the back of the print element substrate H1100, there are formed ink supply ports for supplying ink to the plurality of ink passages. The print element substrate H1100 is securely bonded to the first plate H1200 which is formed with ink supply ports H1201 for supplying ink to the print element substrate H1100. The first plate H1200 is securely bonded with the second plate H1400 having an opening. The second plate H1400 holds the electric wiring board H1300 to electrically connect the electric wiring board H1300 with the print element substrate H1100. The electric wiring board H1300 is to apply electric signals for ejecting ink to the print element substrate H1100, and has electric wires associated with the print element substrate H1100 and external signal input terminals H1301 situated at electric wires' ends for receiving electric signals from the printer body. The external signal input terminals H1301 are positioned and fixed at the back of a tank holder H1500 described later.

The tank holder H1500 that removably holds the ink tank H1900 is securely attached, as by ultrasonic fusing, with the flow passage forming member H1600 to form an ink passage H1501 from the ink tank H1900 to the first plate H1200. At the ink tank side end of the ink passage H1501 that engages with the ink tank H1900, a filter H1700 is provided to prevent external dust from entering. A seal rubber H1800 is provided at a portion where the filter H1700 engages the ink tank H1900, to prevent evaporation of the ink from the engagement portion.

As described above, the tank holder unit, which includes the tank holder H1500, the flow passage forming member H1600, the filter H1700 and the seal rubber H1800, and the print element unit, which includes the print element substrate H1100, the first plate H1200, the electric wiring board H1300 and the second plate H1400, are combined as by adhesives to form the print head H1001.

I.4.2 Carriage

Figure 9:
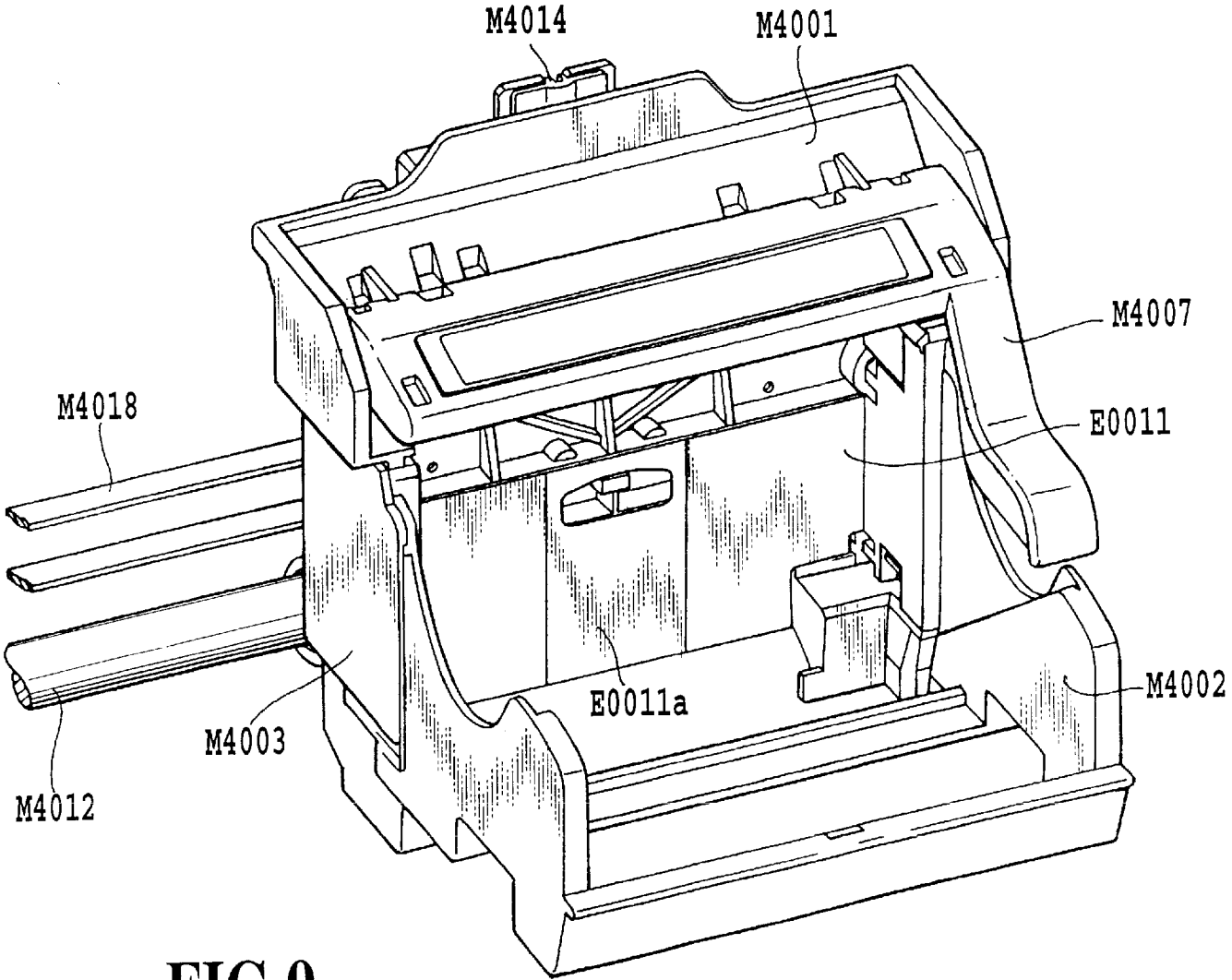
FIG. 9 is a perspective view showing the front side of a carriage used in the embodiment of the invention.

Next, by referring to FIGS. 2, 9 and 10, the carriage M4001 carrying the print head cartridge H1000 will be explained.

As shown in FIG. 2, the carriage M4001 has a carriage cover M4002 for guiding the print head H1001 to a predetermined mounting position on the carriage M4001, and a head set lever M4007 that engages and presses against the tank holder H1500 of the print head H1001 to set the print head H1001 at a predetermined mounting position.

That is, the head set lever M4007 is provided at the upper part of the carriage M4001 so as to be pivotable about a head set lever shaft M4008. There is a spring-loaded head set plate (not shown) at an engagement portion where the carriage M4001 engages the print head H1001. With the spring force, the head set lever M4007 presses against the print head H1001 to mount it on the carriage M4001.

At another engagement portion of the carriage M4001 with the print head H1001, there is provided a contact flexible printed cable (simply referred to as a contact FPC hereinafter) E0011 whose contact unit E0011*a* electrically contacts a contact portion (external signal input terminals) H1301 provided in the print head H1001 to transfer various information for printing and supply electricity to the print head H1001.

An elastic member such as rubber not shown is provided between a contact unit E0011*a* of a contact FPC E0011 and the carriage M4001. The elastic force of the elastic member and the pressing force of the head set lever spring combine to ensure a reliable contact between the contact unit E0011*a* and the carriage M4001. The contact FPC E0011 is drawn to the sides of the carriage M4001 and, as shown in FIGS. 9 and 10, has its end portions securely held to the sides of the carriage M4001 by a pair of FPC retainers M4003, M4006. The contact FPC E0011 is connected to a carriage printed circuit board E0013 mounted on the back of the carriage M4001 (see FIG. 10).

Figure 10:
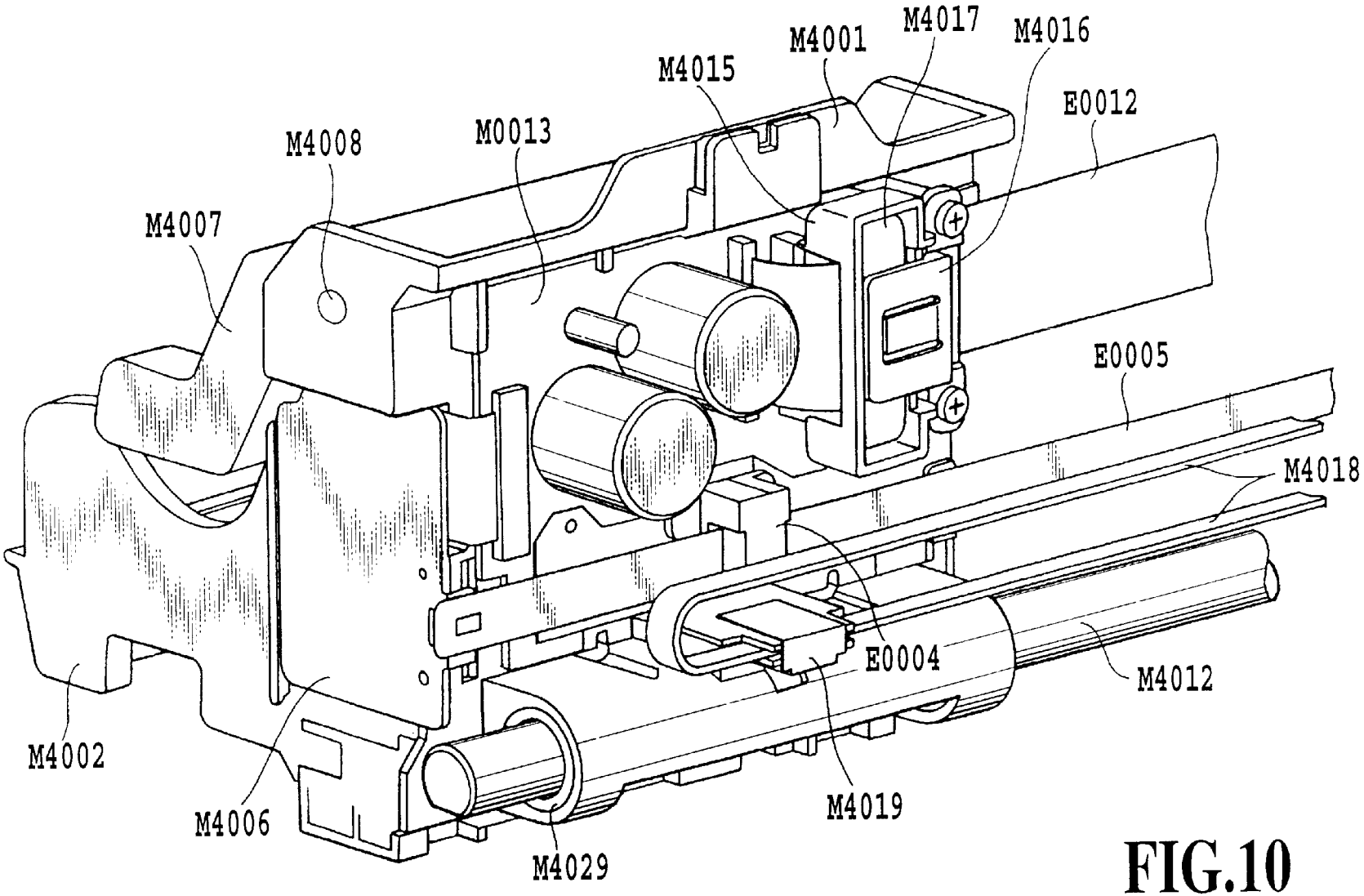
FIG. 10 is a perspective view showing the back side of the carriage of FIG. 9.

As shown in FIG. 10, the carriage printed circuit board E0013 is electrically connected through a carriage flexible flat cable (carriage FFC) E0012 to a main printed circuit board E0014 mounted on the chassis M3019 (see FIG. 15), which will be described later. Further, as shown in FIG. 10, at a joint portion between one end of the carriage FFC E0012 and the carriage printed circuit board E0013 a pair of retainer members, flexible flat cable retainers (FCC retainers) M4015, M4016, are provided to fixedly secure the carriage FFC E0012 to the carriage printed circuit board E0013 (see FIG. 15). Also installed at the joint portion is a ferrite core M4017 that shields electromagnetic radiations emitted from the carriage FFC E0012 and others.

The other end of the carriage FFC E0012 is fixed to the chassis M3019 (FIG. 2) by an FFC retainer M4028 (FIG. 2) and then drawn out to the rear side of the chassis M3019 through a hole not shown in the chassis M3019 and connected to the main printed circuit board E0014 (FIG. 15).

As shown in FIG. 10, the carriage printed circuit board E0013 has an encoder sensor E0004, which detects information from an encoder scale E0005 extending parallel to the carriage shaft M4012 between the both sides of the chassis M3019 to detect the position and scan speed of the carriage M4001. In this embodiment, the encoder sensor E0004 is of an optical transmission type. The encoder scale E0005 is a resin film, such as polyester film, which is printed, by the photographic plate making technique, alternately at a predetermined pitch with light shielding portions for shielding detection light emitted from the encoder sensor and light transmitting portions for transmitting the detection light.

Therefore, the position of the carriage M4001 moving along the carriage shaft M4012 can be detected at any time by first putting the carriage M4001 against one side plate of the chassis M3019 provided at an end of the scanning track of the carriage M4001, taking this position as a reference position, and counting the number of patterns formed on the encoder scale E0005 by the encoder sensor E0004 as the carriage M4001 performs scanning.

The carriage M4001 is guided for scan operation along the carriage shaft M4012 and the carriage rail M4013 extending between the both sides of the chassis M3019. At bearing portions for the carriage shaft M4012, the carriage M4001 has integrally formed therewith as by an insert molding a pair of carriage shaft bearings M4029 made of a sintered metal impregnated with lubricant such as oil. Further, at a portion engaging with the carriage rail M4013, the carriage M4001 has a carriage slider (CR slider) M4014 made of resin with excellent sliding performance and wear resistance. Along with the carriage shaft bearings M4029, the CR slider M4014 enables a smooth scanning motion of the carriage M4001.

The carriage M4001 is secured to a carriage belt M4018 that extends almost parallel to the carriage shaft between an idler pulley M4020 (FIG. 2) and a carriage motor pulley M4024 (FIG. 2). The carriage motor E0001 (FIG. 14) drives the carriage motor pulley M4024 to move the carriage belt M4018 in the forward or backward direction and thereby scan the carriage M4001 along the carriage shaft M4012. The carriage motor pulley M4024 is held at a fixed position by the chassis, whereas the idler pulley M4020 together with a pulley holder M4021 is held movable relative to the chassis M3019. Because the idler pulley M4020 is urged away from the carriage motor pulley M4024 by a spring, the carriage belt M4018 wound around the both pulleys M4020 and M4024 is given an appropriate tension at all times and thus kept in good state with no slack.

At the connecting portion between the carriage belt M4018 and the carriage M4001 is provided a carriage belt holder M4019 that ensures a secure holding of the carriage M4001 to the belt.

On the spur stay M2007 in the scanning track of the carriage M4001 an ink empty sensor E0006 (FIG. 2) is exposed facing an ink tank H1900 to measure the remaining amount of ink contained in the ink tank H1900 of the print head cartridge H1000 mounted on the carriage M4001. The ink empty sensor E0006 is held by an ink empty sensor holder M4026 and accommodated in an ink empty sensor cover M4027 having a metal plate to shield noise from outside, thus preventing erroneous operations of the sensor.

I.5 Ejection Performance Recovery Unit

Next, by referring to FIGS. 11 and 12, an ejection performance recovery unit that recovers the ejection performance of the print head cartridge H1000 will be described.

The ejection performance recovery unit 5000 in this embodiment can be mounted to and dismounted from the printer body M1000. The ejection performance recovery unit M5000 has a cleaning means to remove foreign matters adhering to a print element substrate H1100 of the print head H1001 and a recovery means to reinstate the normal condition of the ink path from the ink tank H1900 to the print element substrate H1100 of the print head H1001 (flow path from the portions H1501 to H1400 via H1600).

Figure 11:
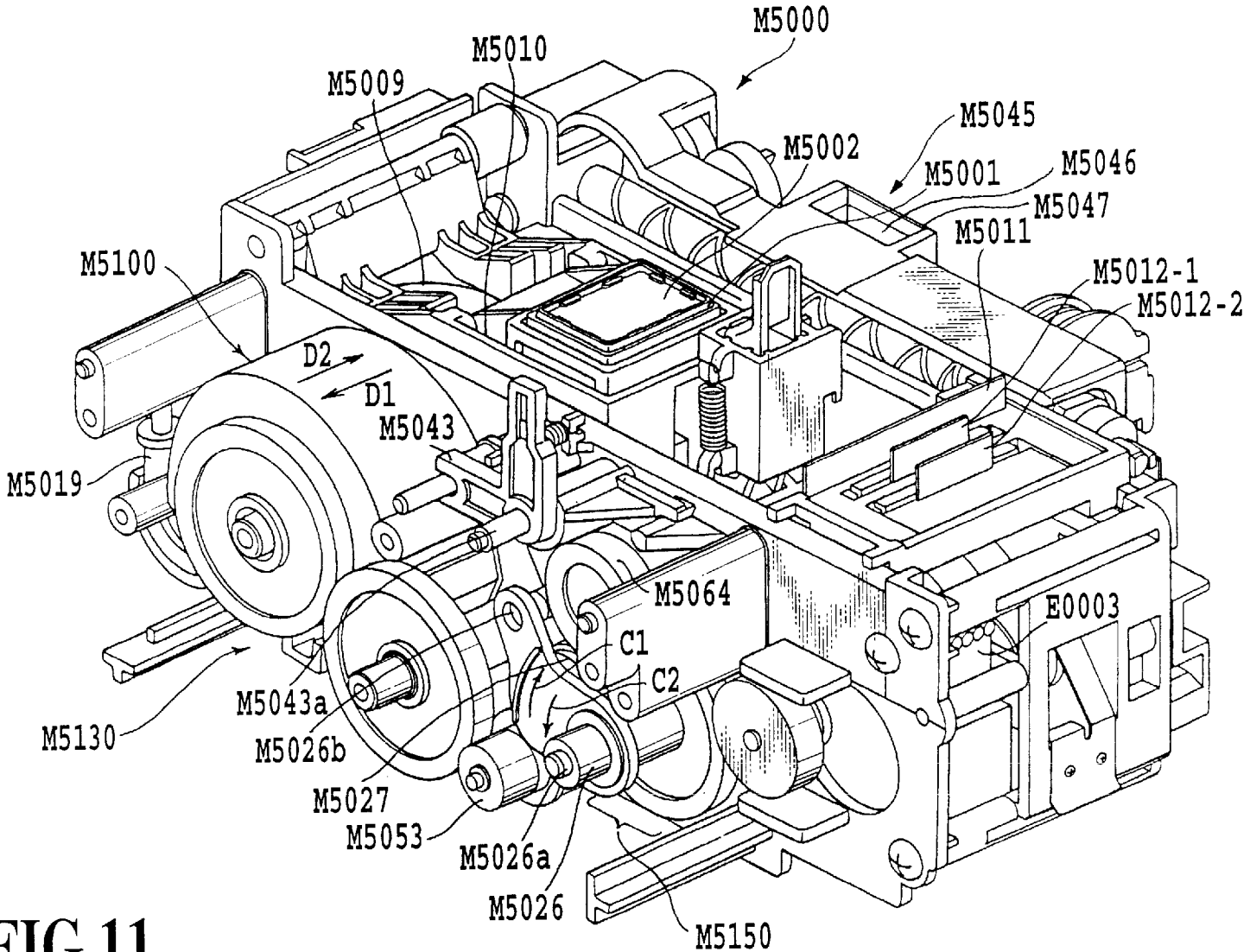
FIG. 11 is a perspective view showing one side of an ejection performance recovery unit in the embodiment of the invention.
Figure 12:
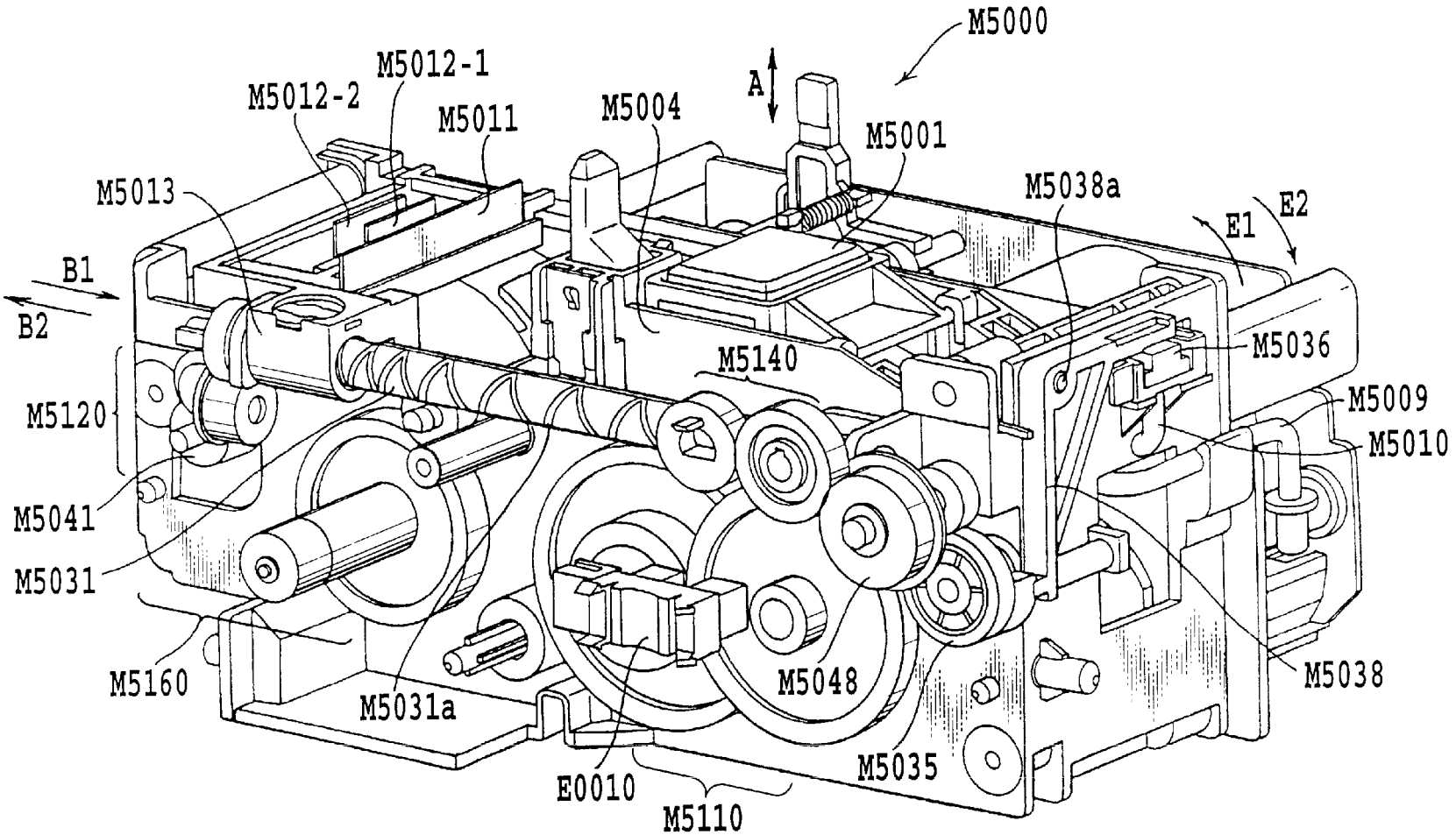
FIG. 12 is a perspective view showing the other side of the ejection performance recovery unit of FIG. 11.

In FIGS. 11 and 12, denoted E0003 is a PG motor which drives a cap M5001 to be described later, a pump M5100, wiper blades M5011, M5012-1, M5012-2 and the automatic sheet feed unit M3022. The driving force is extracted from both sides of the motor shaft of the PG motor E0003. The driving force extracted from one side is transmitted to the pump M5100 or the automatic sheet feed unit M3022 through a drive path switching means described later. The driving force extracted from the other side is transmitted to the cap M5001 and the wiper blades M5011, M5012-1, M5012-2 through a one-way clutch M5041 that engages when the PG motor E0003 rotates only in a particular direction (this rotation direction is referred to as a forward direction and the opposite direction as a reverse direction). Hence, when the PG motor E0003 is rotating in the reverse direction, the one-way clutch M5041 disengages blocking the driving force from being transmitted, so that the cap M5001 and the wiper blades M5011, M5012-1, M5012-2 are not operated.

The cap M5001 is made of an elastic member such as rubber and mounted on a cap lever M5004 that can be pivoted about its axis. The cap M5001 is moved in the direction of arrow A (FIG. 12) through the one-way clutch M5041, a cap drive transmission gear train M5110, a cap cam and the cap lever M5004 so that it can be brought into and out of contact with the print element substrate H1100 of the print head H1001. In the cap M5001 there is provided an absorbing member M5002 which is arranged to oppose the print element substrate H1100 with a predetermined gap therebetween during a capping operation.

The absorbing member M5002 disposed in this way can accept ink drawn out from the print head cartridge H1000 during the suction operation. Further, the ink in the cap M5001 can be discharged out into a used ink absorbing member completely by an evacuation operation described later. The cap M5001 is connected with two tubes, a cap tube M5009 and a valve tube M5010. The cap tube M5009 is connected to a pump tube M5019 of a pump M5100 described later and the valve tube M5010 to a valve rubber M5036 described later.

The wiper blades M5011, M5012-1, M5012-2 are made of elastic members such as rubber and are erected on a blade holder M5013 so that their edges project upward. The blade holder M5013 has a lead screw M5031 inserted therethrough with a projection not shown of the blade holder M5013 movably engaging in a groove formed in the lead screw M5031. As the lead screw M5031 rotates, the blade holder M5013 moves back and forth along the lead screw M5031 in the direction of arrow B1 or B2 (FIG. 12), causing the wiper blades M5011, M5012-1, M5012-2 to wipe clean the print element substrate H1100 of the print head cartridge H1000. The lead screw M5031 is connected to one side of the PG motor E0003 through the one-way clutch M5041 and a wiper drive transmission gear train M5120.

Designated M5100 is a pump that produces a pressure by pressing a roller (not shown) against and moving it along the pump tube M5019. This pump is connected to the other side of the PG motor E0003 via a drive path switching means and the pump drive transmission gear train M5130. The drive path switching means switches the driving force transmission path between the automatic sheet feed unit M3022 and the pump M5100. Although details are not provided, the pump M5100 has a mechanism to release the pressing force with which the roller (not shown) is pressed against the pump tube M5019 to squeeze it. When the PG motor E0003 rotates in the forward direction, the mechanism releases the pressing force from the roller, leaving the tube intact. When the PG motor E0003 rotates in the reverse direction, the mechanism applies the pressing force to the roller to squeeze the tube. One end of the pump tube M5019 is connected to the cap M5001 through the cap tube M5009.

The drive path switching means has a pendulum arm M5026 and a selector lever M5043. The pendulum arm M5026 is pivotable about a shaft M5026*a* in the direction of arrow C1 or C2 (FIG. 11) depending on the rotation direction of the PG motor E0003. The selector lever M5043 is switched according to the position of the carriage M4001. That is, when the carriage moves M4001 to a position over the ejection performance recovery unit M5000, a part of the selector lever M5043 is contacted by a part of the carriage M4001 and moved in the direction of arrow D1 or D2 (FIG. 11) depending on the position of the carriage M4001, with the result that a lock hole M5026*b* of the pendulum arm M5026 and a lock pin M5043*a* of the selector lever M5043 engage.

The valve rubber M5036 is connected with one end of the valve tube M5010 the other end of which is connected to the cap M5001. A valve lever M5038 is connected to the discharge roller 2003 (FIG. 5) through a valve cam M5035, a valve clutch M5048 and a valve drive transmission gear train M5140. As the discharge roller 2003 rotates, the valve lever M5038 is pivoted about a shaft M5038*a* in the direction of arrow E1 or E2 to come into or out of contact with the valve rubber M5036. When the valve lever M5038 is in contact with the valve rubber M5036, the valve is closed. When the lever is parted, the valve is open.

Denoted E0010 is a PG sensor that detects the position of the cap M5001.

Next, the operations of the ejection performance recovery unit M5000 of the above construction will be explained.

First, let us explain about the driving operation of the automatic sheet feed unit M3022.

When, with the carriage M4001 at the retracted position where it does not contact the selector lever M5043, the PG motor E0003 rotates in the reverse direction, the pendulum arm M5026 is pivoted in the direction of arrow Cl (FIG. 11) through a pendulum drive transmission gear train M5150, causing a selector output gear M5027 mounted on the pendulum arm M5026 to mesh with an ASF gear M5064 at one end of an ASF drive transmission gear train M5160. When in this state the PG motor E0003 continues to rotate in the reverse direction, the automatic sheet feed unit M3022 is driven by the PG motor through the ASF drive transmission gear train M5160. At this time, the driving force is not transmitted to the cap M5001 and the wiper blades M5011, M5012-1, M5012-2 because the one-way clutch M5041 is disengaged. Thus, the wiper blades are not operated.

Next, the suction operation of the pump M5100 will be described.

When, with the carriage M4001 at the retracted position where it does not contact the selector lever M5043, the PG motor E0003 rotates in the forward direction, the pendulum arm M5026 is pivoted in the direction of arrow C2 through the pendulum drive transmission gear train M5150, causing the selector output gear M5027 mounted on the pendulum arm M5026 to mesh with a pump gear M5053 at one end of the pump drive transmission gear train M5130.

Then, when the carriage M4001 moves to the capping position (a carriage position where the print element substrate H1100 of the print head cartridge H1000 faces the cap M5001), a part of the carriage M4001 abuts against a part of the selector lever M5043, which is then moved in the direction of D1, causing the lock pin M5043*a* of the selector lever M5043 to fit into the lock hole M5026*b* of the pendulum arm M5026. As a result, the pendulum arm M5026 is locked connected to the pump side.

Here, the discharge roller 2003 is driven in the reverse direction and the valve lever M5038 is rotated in the direction of arrow E1, opening the valve rubber M5036. In this open state, the PG motor E0003 rotates in the forward direction to drive the cap M5001 and the wiper blades M5011, M5012-1, M5012-2 to perform the capping operation (an operation whereby the cap M5001 hermetically contacts and covers the print element substrate H1100 of the print head H1001). At this time, the pump M5100 is operated but the pressing force of a roller (not shown) against the pump tube M5019 is released, so that the pump tube M5019 is not worked and no pressure is generated.

When the discharge roller 2003 is driven in the forward direction and the valve lever M5038 is pivoted in the direction of arrow E2 (FIG. 12), the valve rubber M5036 is closed. At this time, the PG motor E0003 rotates in the reverse direction to squeeze the pump tube M5019 by the pressing force of the roller to apply a negative pressure to the print element substrate H1100 of the print head cartridge H1000 through the cap tube M5009 and the cap M5001, forcibly drawing out ink and foams not suited for printing from the nozzles in the print element substrate H1100.

After this, the PG motor E0003 rotates in the reverse direction and at the same time the discharge roller 2003 is driven in the reverse direction to pivot the valve lever M5038 in the direction of arrow E1 (FIG. 12). Now the valve rubber M5036 is open. As a result, the pressure in the pump tube M5019, the cap tube M5009 and the cap M5001 is equal to an atmospheric pressure, stopping the forced suction of the ink nozzles in the print element substrate H1100 of the print head cartridge H1000. At the same time, the ink contained in the pump tube M5019, the cap tube M5009 and the cap M5001 is drawn out from the other end of the pump tube M5019 into the used ink absorbing member (not shown). This operation is referred to as an evacuation. Then, the PG motor E0003 is stopped, the discharge roller 2003 is driven in the forward direction and the valve lever M5038 is pivoted in the direction of arrow E2 (FIG. 12), closing the valve rubber M5036. Now the suction operation is finished.

Next, the wiping operation will be explained.

During the wiping operation, the PG motor E0003 is first rotated in the forward direction to move the wiper blades M5011, M5012-1, M5012-2 to the wiping start position (a position where the wiper blades M5011, M5012-1, M5012-2 are upstream of the print head cartridge H1000 in the printing operation, with the cap M5001 separated from the print head cartridge H1000). Next, the carriage M4001 moves to a wiping position where the wiper blades M5011, M5012-1, M5012-2 face the print element substrate H1100. At this time, the carriage M4001 is not in contact with the selector lever M5043 and the pendulum arm M5026 is not in the locked state.

Then, the PG motor E0003 rotates in the forward direction to move the wiper blades M5011, M5012-1, M5012-2 in the direction of arrow B1 (FIG. 12) wiping clean the print element substrate H1100 of the print head cartridge H1000. Further, a wiper blade cleaning means (not shown) provided downstream of the print element substrate H1100 of the print head cartridge H1000 in the direction of the printing operation clears the wiper blades of the adhering ink. At this time, the cap M5001 is kept in the separated state.

When the wiper blades reach the wiping end position (a downstream end position in the printing operation), the PG motor is stopped and the carriage M4001 is moved to the wiping standby position out of the wiping operation range of the wiper blades M5011, M5012-1, M5012-2. Then, the PG motor E0003 is rotated in the forward direction to move the wiper blades to the wiping end position. At this time, too, the cap M5001 is maintained in the separated state. Now, the wiping operation is finished.

Next, the preliminary ejection will be explained.

Performing the suction operation and the wiping operation on a print head that uses a plurality of inks may cause a problem of ink mixing.

For example, during the suction operation, ink drawn out from the nozzles may get into nozzles of other color inks and, during the wiping operation, inks of various colors adhering to the circumferences of the nozzles may be pushed into nozzles of different color inks by the wipers. When the next printing is started, the initial part of the printed image may be discolored (or exhibit mixed colors), degrading the printed image.

To prevent the color mixing, the ink that may have mixed with other color inks is ejected out immediately before printing. This is called a preliminary ejection. In this embodiment, as shown in FIG. 11, a preliminary ejection port M5045 is arranged near the cap M5001. Immediately before printing, the print element substrate H1100 of the print head is moved to a position opposing the preliminary ejection port M5045 where it is subjected to the preliminary ejection operation.

The preliminary ejection port M5045 has a preliminary ejection absorbing member M5046 and a preliminary ejection cover M5047. The preliminary ejection absorbing member M5046 communicates with the used ink absorbing member not shown.

I.6 Scanner

The printer of this embodiment can mount a scanner in the carriage M4001 in place of the print head cartridge H1000 and be used as a reading device.

The scanner moves together with the carriage M4001 in the main scan direction, and reads an image on a document fed instead of the printing medium as the scanner moves in the main scan direction. Alternating the scanner reading operation in the main scan direction and the document feed in the sub-scan direction enables one page of document image information to be read.

Figure 13B:
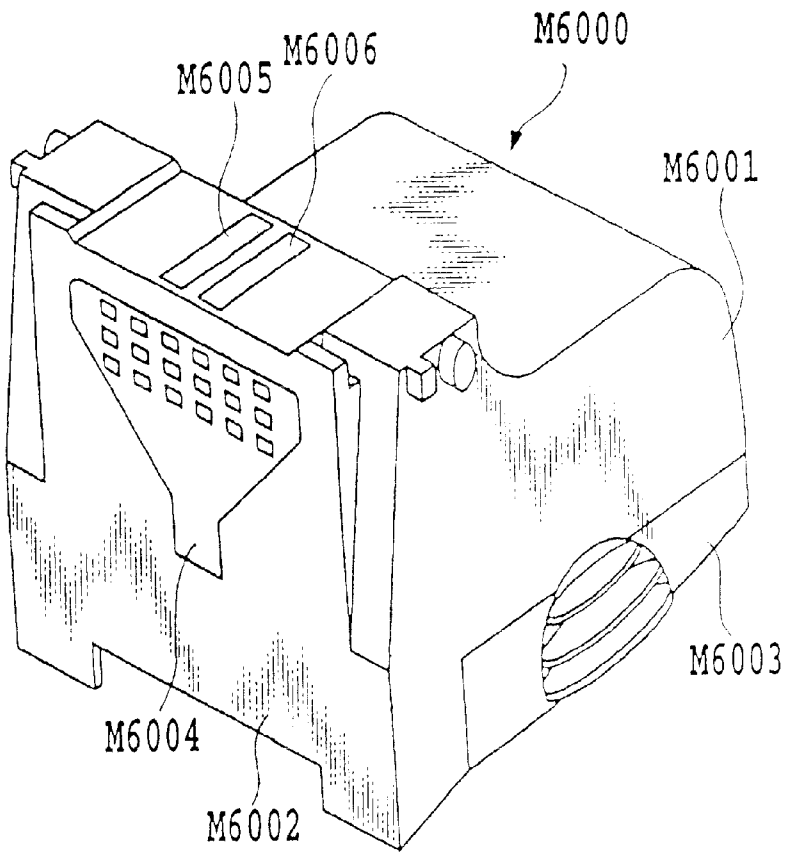
FIGS. 13A and 13B are perspective views showing a construction of a scanner cartridge upside down which can be mounted in the printer of one embodiment of the present invention instead of the print head cartridge of FIG. 6.
Figure 13A:
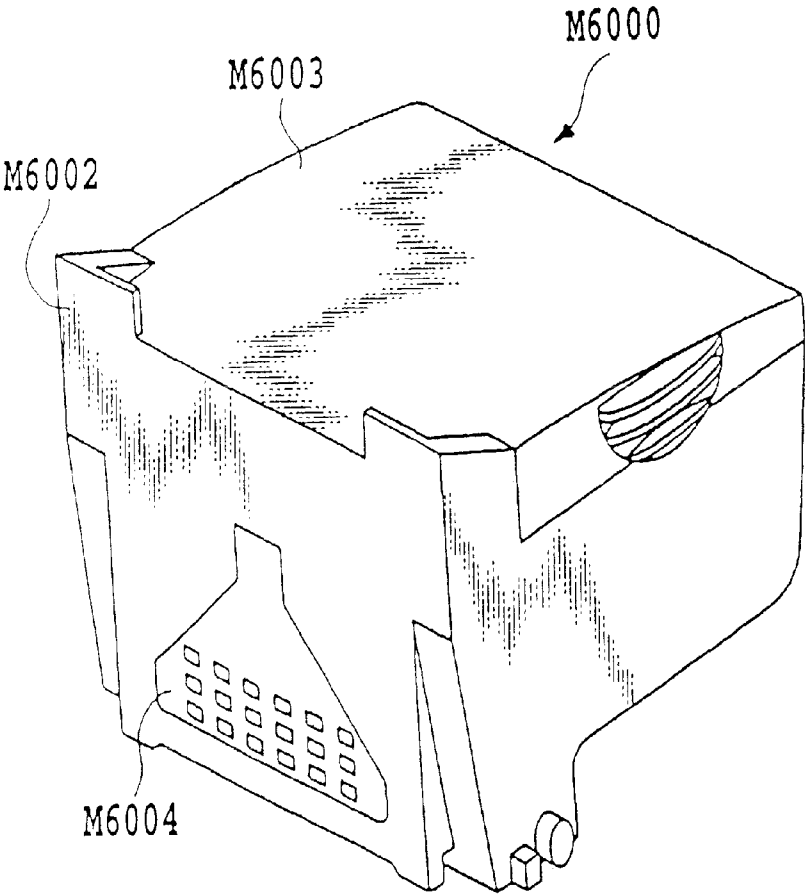

FIGS. 13A and 13B show the scanner M6000 upside down to explain about its outline construction.

As shown in the figure, a scanner holder M6001 is shaped like a box and contains an optical system and a processing circuit necessary for reading. A reading lens M6006 is provided at a portion that faces the surface of a document when the scanner M6000 is mounted on the carriage M4001. The lens M6006 focuses light reflected from the document surface onto a reading unit inside the scanner to read the document image. An illumination lens M6005 has a light source not shown inside the scanner. The light emitted from the light source is radiated onto the document through the lens M6005.

The scanner cover M6003 secured to the bottom of the scanner holder M6001 shields the interior of the scanner holder M6001 from light. Louver-like grip portions are provided at the sides to improve the ease with which the scanner can be mounted to and dismounted from the carriage M4001. The external shape of the scanner holder M6001 is almost similar to that of the print head H1001, and the scanner can be mounted to or dismounted from the carriage M4001 in a manner similar to that of the print head H1001.

The scanner holder M6001 accommodates a substrate having a reading circuit, and a scanner contact PCB M6004 connected to this substrate is exposed outside. When the scanner M6000 is mounted on the carriage M4001, the scanner contact PCB M6004 contacts the contact FPC E0011 of the carriage M4001 to electrically connect the substrate to a control system on the printer body side through the carriage M4001.

I.7 Storage Box

FIG. 14 shows a storage box M6100 for storing the print head H1001.

The storage box M6100 comprises a storage box base M6101 having an opening at its top, a storage box cover M6102 pivotally mounted on the storage box base M6101 to open and close the opening, a storage box cap M6103 secured to the bottom of the storage box base M6101, and a leaf spring-like storage box spring M6104 secured to the inner top portion of the storage box cover M6102.

When the print head is to be stored in the storage box of the above construction, the print head is inserted into the storage box base M6101 so that the nozzle portion faces the storage box cap and then the storage box cover M6102 is closed to engage a locking portion of the storage box base M6101 with the storage box cover M6102 to keep the storage box cover M6102 in a closed state. Because the storage box spring M6104 in this closed state applies a pressing force to the print head H1001, the nozzle portion of the print head H1001 is hermetically covered by the storage box cap M6103. Therefore, this storage box can protect the print head nozzles against dust and ink evaporation and therefore maintain the print head in good condition for a long period of time.

The storage box M6100 for storing the print head H1001 can also be used for storing the scanner M6000. It is noted, however, that because the storage box cap M6103 that protects the nozzle portion of the print head H1001 is smeared with ink, it is strongly suggested that to prevent the ink from adhering to the scanner, the scanner be stored so that the scanner surface on which the scanner reading lens M6006 and the scanner illumination lens M6005 are arranged is directed away from the storage box cap M6103.

I.8 Example Configuration of Printer Electric Circuit

Next, an electric circuit configuration in this embodiment of the invention will be explained.

FIG. 15 schematically shows the overall configuration of the electric circuit in this embodiment.

The electric circuit in this embodiment comprises mainly a carriage substrate (CRPCB) E0013, a main PCB (printed circuit board) E0014 and a power supply unit E0015.

The power supply unit E0015 is connected to the main PCB E0014 to supply a variety of drive power.

The carriage substrate E0013 is a printed circuit board unit mounted on the carriage M4001 (FIG. 2) and functions as an interface for transferring signals to and from the print head through the contact FPC E0011. In addition, based on a pulse signal output from an encoder sensor E0004 as the carriage M4001 moves, the carriage substrate E0013 detects a change in the positional relation between an encoder scale E0005 and the encoder sensor E0004 and sends its output signal to the main PCB E0014 through a flexible flat cable (CRFFC) E0012.

Further, the main PCB E0014 is a printed circuit board unit that controls the operation of various parts of the ink jet printing apparatus in this embodiment, and has I/O ports for a paper end sensor (PE sensor) E0007, an automatic sheet feeder (ASF) sensor E0009, a cover sensor E0022, a parallel interface (parallel I/F) E0016, a serial interface (Serial I/F) E0017, a resume key E0019, an LED E0020, a power key E0018 and a buzzer E0021. The main PCB E0014 is connected to and controls a motor (CR motor) E0001 that constitutes a drive source for moving the carriage M4001 in the main scan direction; a motor (LF motor) E0002 that constitutes a drive source for transporting the printing medium; and a motor (PG motor) E0003 that performs the functions of recovering the ejection performance of the print head and feeding the printing medium. The main PCB E0014 also has connection interfaces with an ink empty sensor E0006, a gap sensor E0008, a PG sensor E0010, the CRFFC E0012 and the power supply unit E0015.

Figures 16, 16A:
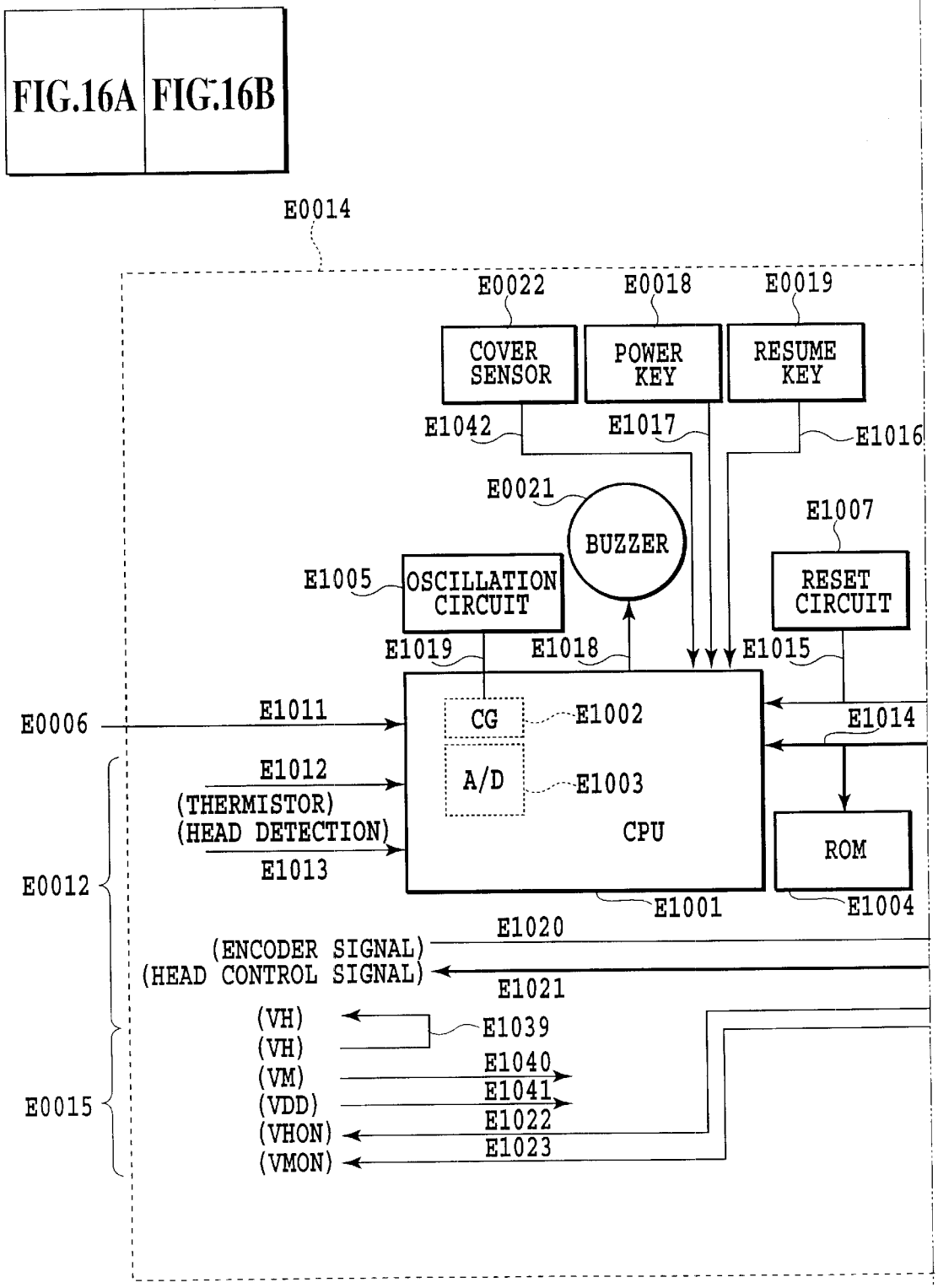
FIG. 16 is a diagram showing the relation between FIGS. 16A and 16B, FIGS. 16A and 16B being block diagrams representing an example inner configuration of a main printed circuit board (PCB) in the electric circuitry of FIG. 15.
Figure 16B:
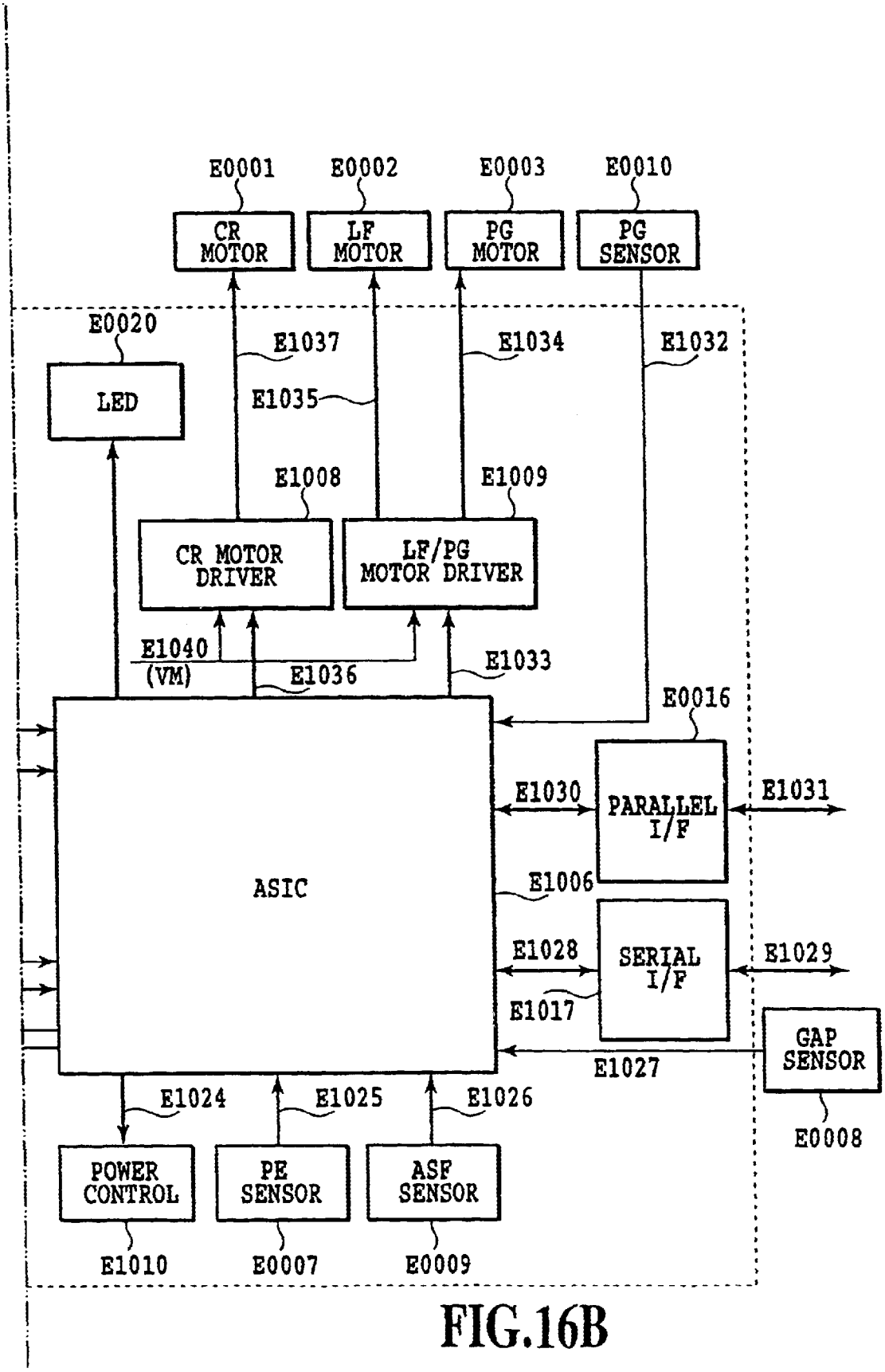

FIG. 16 is a diagram showing the relation between FIGS. 16A and 16B, and FIGS. 16A and 16B are block diagrams showing an inner configuration of the main PCB E0014.

Reference number E1001 represents a CPU, which has a clock generator (CG) E1002 connected to an oscillation circuit E1005 to generate a system clock based on an output signal E1019 of the oscillation circuit E1005. The CPU E1001 is connected to an ASIC (application specific integrated circuit) and a ROM E1004 through a control bus E1014. According to a program stored in the ROM E1004, the CPU E1001 controls the ASIC E1006, checks the status of an input signal E1017 from the power key, an input signal E1016 from the resume key, a cover detection signal E1042 and a head detection signal (HSENS) E1013, drives the buzzer E0021 according to a buzzer signal (BUZ) E1018, and checks the status of an ink empty detection signal (INKS) E1011 connected to a built-in A/D converter E1003 and of a temperature detection signal (TH) E1012 from a thermistor. The CPU E1001 also performs various other logic operations and makes conditional decisions to control the operation of the ink jet printing apparatus.

The head detection signal E1013 is a head mount detection signal entered from the print head cartridge H1000 through the flexible flat cable E0012, the carriage substrate E0013 and the contact FPC E0011. The ink empty detection signal E1011 is an analog signal output from the ink empty sensor E0006. The temperature detection signal E1012 is an analog signal from the thermistor (not shown) provided on the carriage substrate E0013.

Designated E1008 is a CR motor driver that uses a motor power supply (VM) E1040 to generate a CR motor drive signal E1037 according to a CR motor control signal E1036 from the ASIC E1006 to drive the CR motor E0001. E1009 designates an LF/PG motor driver which uses the motor power supply E1040 to generate an LF motor drive signal E1035 according to a pulse motor control signal (PM control signal) E1033 from the ASIC E1006 to drive the LF motor. The LF/PG motor driver E1009 also generates a PG motor drive signal E1034 to drive the PG motor.

Designated E1010 is a power supply control circuit which controls the supply of electricity to respective sensors with light emitting elements according to a power supply control signal E1024 from the ASIC E1006. The parallel I/F E0016 transfers a parallel I/F signal E1030 from the ASIC E1006 to a parallel I/F cable E1031 connected to external circuits and also transfers a signal of the parallel I/F cable E1031 to the ASIC E1006. The serial I/F E0017 transfers a serial I/F signal E1028 from the ASIC E1006 to a serial I/F cable E1029 connected to external circuits, and also transfers a signal from the serial I/F cable E1029 to the ASIC E1006.

The power supply unit E0015 provides a head power signal (VH) E1039, a motor power signal (VM) E1040 and a logic power signal (VDD) E1041. A head power ON signal (VHON) E1022 and a motor power ON signal (VMON) E1023 are sent from the ASIC E1006 to the power supply unit E0015 to perform the ON/OFF control of the head power signal E1039 and the motor power signal E1040. The logic power signal (VDD) E1041 supplied from the power supply unit E0015 is voltage-converted as required and given to various parts inside or outside the main PCB E0014.

The head power signal E1039 is smoothed by a circuit of the main PCB E0014 and then sent out to the flexible flat cable E0011 to be used for driving the print head cartridge H1000. E1007 denotes a reset circuit which detects a reduction in the logic power signal E1041 and sends a reset signal (RESET) to the CPU E1001 and the ASIC E1006 to initialize them.

The ASIC E1006 is a single-chip semiconductor integrated circuit and is controlled by the CPU E1001 through the control bus E1014 to output the CR motor control signal E1036, the PM control signal E1033, the power supply control signal E1024, the head power ON signal E1022 and the motor power ON signal E1023. It also transfers signals to and from the parallel interface E0016 and the serial interface E0017. In addition, the ASIC E1006 detects the status of a PE detection signal (PES) E1025 from the PE sensor E0007, an ASF detection signal (ASFS) E1026 from the ASF sensor E0009, a gap detection signal (GAPS) E1027 from the GAP sensor E0008 for detecting a gap between the print head and the printing medium, and a PG detection signal (PGS) E1032 from the PG sensor E001O, and sends data representing the statuses of these signals to the CPU E1001 through the control bus E1014. Based on the data received, the CPU E1001 controls the operation of an LED drive signal E1038 to turn on or off the LED E0020.

Further, the ASIC E1006 checks the status of an encoder signal (ENC) E1020, generates a timing signal, interfaces with the print head cartridge H1000 and controls the print operation by a head control signal E1021. The encoder signal (ENC) E1020 is an output signal of the CR encoder sensor E0004 received through the flexible flat cable E0012. The head control signal E1021 is sent to the print head H1001 through the flexible flat cable E0012, carriage substrate E0013 and contact FPC E0011.

Figures 17, 17A:
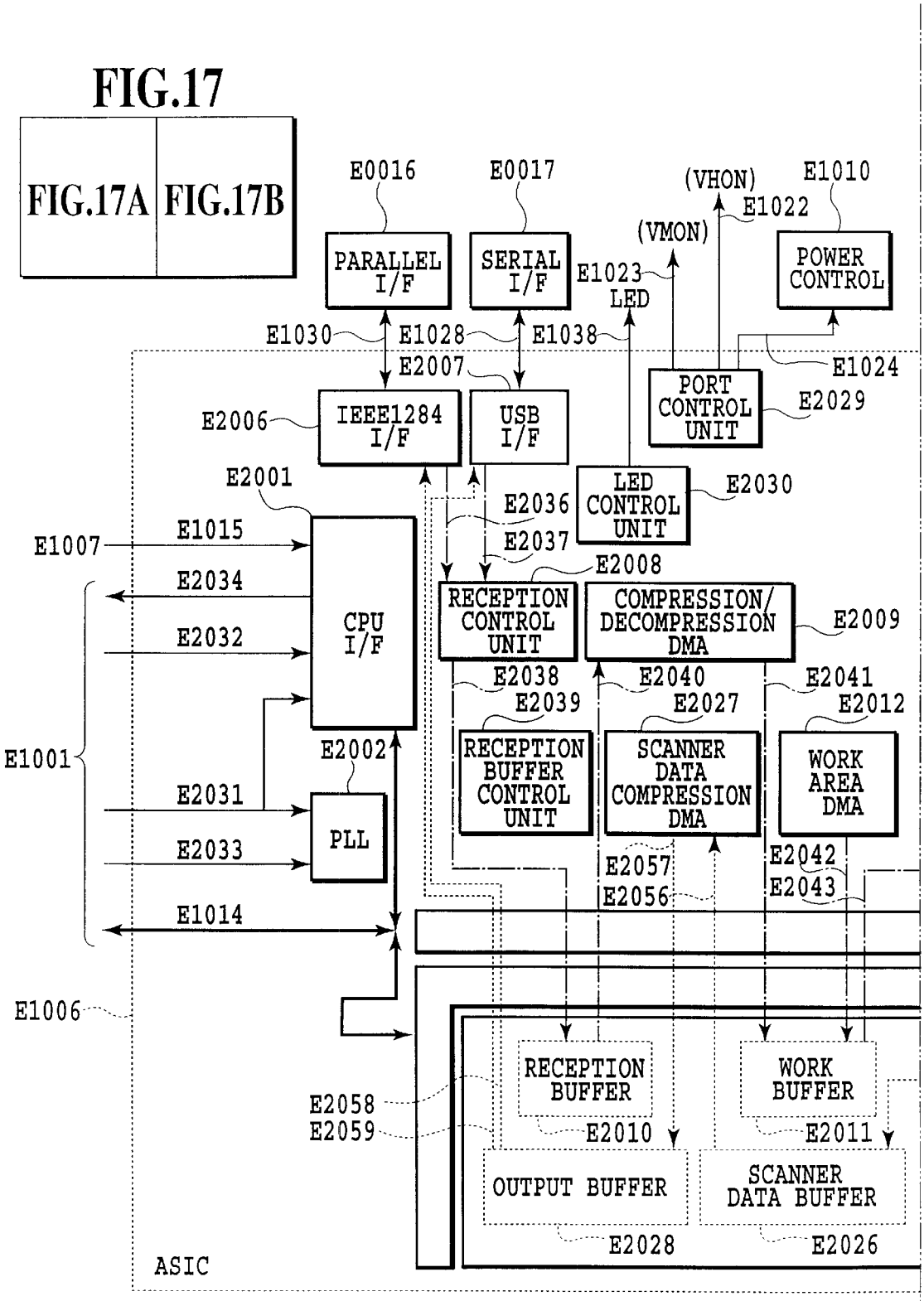
FIG. 17 is a diagram showing the relation between FIGS. 17A and 17B, FIGS. 17A and 17B being block diagrams representing an example inner configuration of an application specific integrated circuit (ASIC) in the main PCB of FIGS. 16A and 16B.
Figure 17B:
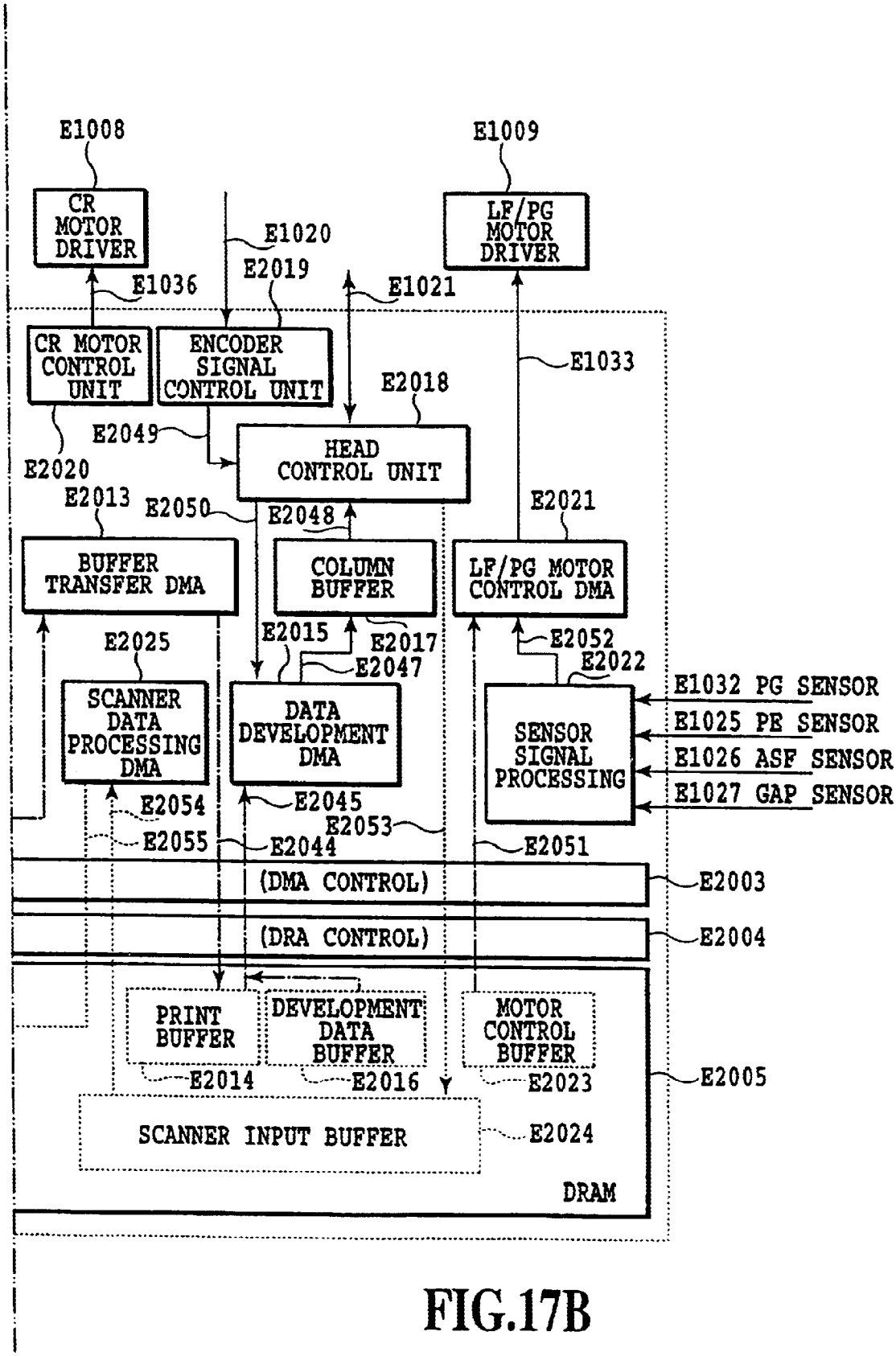

FIG. 17 is a diagram showing the relation between FIGS. 17A and 17B, and FIGS. 17A and 17B are block diagrams showing an example internal configuration of the ASIC E1006.

In these figures, only the flow of data, such as print data and motor control data, associated with the control of the head and various mechanical components is shown between each block, and control signals and clock associated with the read/write operation of the registers incorporated in each block and control signals associated with the DMA control are omitted to simplify the drawing.

In the figures, reference number E2002 represents a PLL controller which, based on a clock signal (CLK) E2031 and a PLL control signal (PLLON) E2033 output from the CPU E1001 shown in FIGS. 16A, generates a clock (not shown) to be supplied to the most part of the ASIC E1006.

Denoted E2001 is a CPU interface (CPU I/F) E2001, which controls the read/write operation of register in each block, supplies a clock to some blocks and accepts an interrupt signal (none of these operations are shown) according to a reset signal E1015, a software reset signal (PDWN) E2032 and a clock signal (CLK) E2031 output from the CPU E1001, and control signals from the control bus E1014. The CPU I/F E2001 then outputs an interrupt signal (INT) E2034 to the CPU E1001 to inform it of the occurrence of an interrupt within the ASIC E1006.

E2005 denotes a DRAM which has various areas for storing print data, such as a reception buffer E2010, a work buffer E2011, a print buffer E2014 and a development data buffer E2016. The DRAM E2005 also has a motor control buffer E2023 for motor control and, as buffers used instead of the above print data buffers during the scanner operation mode, a scanner input buffer E2024, a scanner data buffer E2026 and an output buffer E2028.

The DRAM E2005 is also used as a work area by the CPU E1001 for its own operation. Designated E2004 is a DRAM control unit E2004 which performs read/write operations on the DRAM E2005 by switching between the DRAM access from the CPU E1001 through the control bus and the DRAM access from a DMA control unit E2003 described later.

The DMA control unit E2003 accepts request signals (not shown) from various blocks and outputs address signals and control signals (not shown) and, in the case of write operation, write data E2038, E2041, E2044, E2053, E2055, E2057 etc. to the DRAM control unit to make DRAM accesses. In the case of read operation, the DMA control unit E2003 transfers the read data E2040, E2043, E2045, E2051, E2054, E2056, E2058, E2059 from the DRAM control unit E2004 to the requesting blocks.

Denoted E2006 is an IEEE 1284 I/F which functions as a bi-directional communication interface with external host devices, not shown, through the parallel I/F E0016 and is controlled by the CPU E1001 via CPU I/F E2001. During the printing operation, the IEEE 1284 I/F E2006 transfers the receive data (PIF receive data E2036) from the parallel I/F E0016 to a reception control unit E2008 by the DMA processing. During the scanner reading operation, the 1284 I/F E2006 sends the data (1284 transmit data (RDPIF) E2059) stored in the output buffer E2028 in the DRAM E2005 to the parallel I/F E0016 by the DMA processing.

Designated E2007 is a universal serial bus (USB) I/F which offers a bi-directional communication interface with external host devices, not shown, through the serial I/F E0017 and is controlled by the CPU E1001 through the CPU I/F E2001. During the printing operation, the universal serial bus (USB) I/F E2007 transfers received data (USB receive data E2037) from the serial I/F E0017 to the reception control unit E2008 by the DMA processing. During the scanner reading, the universal serial bus (USB) I/F E2007 sends data (USB transmit data (RDUSB) E2058) stored in the output buffer E2028 in the DRAM E2005 to the serial I/F E0017 by the DMA processing. The reception control unit E2008 writes data (WDIF E2038) received from the 1284 I/F E2006 or universal serial bus (USB) I/F E2007, whichever is selected, into a reception buffer write address managed by a reception buffer control unit E2039. Designated E2009 is a compression/decompression DMA controller which is controlled by the CPU E1001 through the CPU I/F E2001 to read received data (raster data) stored in a reception buffer E2010 from a reception buffer read address managed by the reception buffer control unit E2039, compress or decompress the data (RDWK) E2040 according to a specified mode, and write the data as a print code string (WDWK) E2041 into the work buffer area.

Designated E2013 is a print buffer transfer DMA controller which is controlled by the CPU E1001 through the CPU I/F E2001 to read print codes (RDWP) E2043 on the work buffer E2011 and rearrange the print codes onto addresses on the print buffer E2014 that match the sequence of data transfer to the print head cartridge H1000 before transferring the codes (WDWP E2044). Reference number E2012 denotes a work area DMA controller which is controlled by the CPU E1001 through the CPU I/F E2001 to repetitively write specified work fill data (WDWF) E2042 into the area of the work buffer whose data transfer by the print buffer transfer DMA controller E2013 has been completed.

Designated E2015 is a print data development DMA controller E2015, which is controlled by the CPU E1001 through the CPU I/F E2001. Triggered by a data development timing signal E2050 from a head control unit E2018, the print data development DMA controller E2015 reads the print code that was rearranged and written into the print buffer and the development data written into the development data buffer E2016 and writes developed print data (RDHDG) E2045 into the column buffer E2017 as column buffer write data (WDHDG) E2047. The column buffer E2017 is an SRAM that temporarily stores the transfer data (developed print data) to be sent to the print head cartridge H1000, and is shared and managed by both the print data development DMA CONTROLLER and the head control unit through a handshake signal (not shown).

Designated E2018 is a head control unit E2018 which is controlled by the CPU E1001 through the CPU I/F E2001 to interface with the print head cartridge H1000 or the scanner through the head control signal. It also outputs a data development timing signal E2050 to the print data development DMA controller according to a head drive timing signal E2049 from the encoder signal processing unit E2019.

During the printing operation, the head control unit E2018, when it receives the head drive timing signal E2049, reads developed print data (RDHD) E2048 from the column buffer and outputs the data to the print head cartridge H1000 as the head control signal E1021.

In the scanner reading mode, the head control unit E2018 DMA-transfers the input data (WDHD) E2053 received as the head control signal E1021 to the scanner input buffer E2024 on the DRAM E2005. Designated E2025 is a scanner data processing DMA controller E2025 which is controlled by the CPU E1001 through the CPU I/F E2001 to read input buffer read data (RDAV) E2054 stored in the scanner input buffer E2024 and writes the averaged data (WDAV) E2055 into the scanner data buffer E2026 on the DRAM E2005.

Designated E2027 is a scanner data compression DMA controller which is controlled by the CPU E1001 through the CPU I/F E2001 to read processed data (RDYC) E2056 on the scanner data buffer E2026, perform data compression, and write the compressed data (WDYC) E2057 into the output buffer E2028 for transfer.

Designated E2019 is an encoder signal processing unit which, when it receives an encoder signal (ENC), outputs the head drive timing signal E2049 according to a mode determined by the CPU E1001. The encoder signal processing unit E2019 also stores in a register information on the position and speed of the carriage M4001 obtained from the encoder signal E1020 and presents it to the CPU E1001. Based on this information, the CPU E1001 determines various parameters for the CR motor E0001. Designated E2020 is a CR motor control unit which is controlled by the CPU E1001 through the CPU I/F E2001 to output the CR motor control signal E1036.

Denoted E2022 is a sensor signal processing unit which receives detection signals E1032, E1025, E1026 and E1027 output from the PG sensor E0010, the PE sensor E0007, the ASF sensor E0009 and the gap sensor E0008, respectively, and transfers these sensor information to the CPU E1001 according to the mode determined by the CPU E1001. The sensor signal processing unit E2022 also outputs a sensor detection signal E2052 to a DMA controller E2021 for controlling LF/PG motor.

The DMA controller E2021 for controlling LF/PG motor is controlled by the CPU E1001 through the CPU I/F E2001 to read a pulse motor drive table (RDPM) E2051 from the motor control buffer E2023 on the DRAM E2005 and output a pulse motor control signal E1033. Depending on the operation mode, the controller outputs the pulse motor control signal E1033 upon reception of the sensor detection signal as a control trigger.

Designated E2030 is an LED control unit which is controlled by the CPU E1001 through the CPU I/F E2001 to output an LED drive signal E1038. Further, designated E2029 is a port control unit which is controlled by the CPU E1001 through the CPU I/F E2001 to output the head power ON signal E1022, the motor power ON signal E1023 and the power supply control signal E1024.

I.9 Operation of Printer

Figure 18:
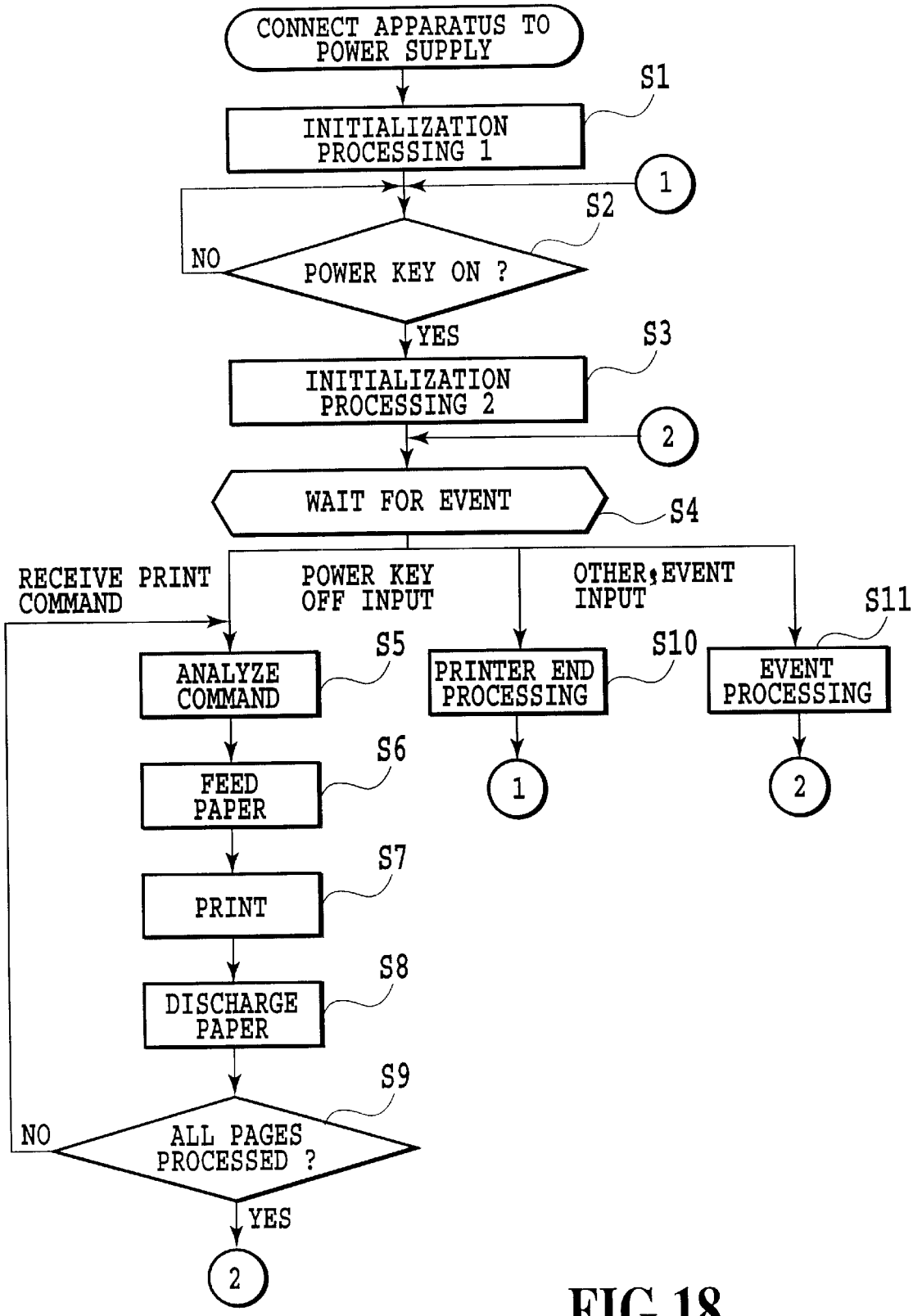
FIG. 18 is a flow chart showing an example of operation of the printer as one embodiment of the present invention.

Next, the operation of the ink jet printing apparatus in this embodiment of the invention with the above configuration will be explained by referring to the flow chart of FIG. 18.

When the printer body M1000 is connected to an AC power supply, a first initialization is performed at step S1. In this initialization process, the electric circuit system including the ROM and RAM in the apparatus is checked to confirm that the apparatus is electrically operable.

Next, step S2 checks if the power key E0018 on the upper case M1002 of the printer body M1000 is turned on. When it is decided that the power key E0018 is pressed, the processing moves to the next step S3 where a second initialization is performed.

In this second initialization, a check is made of various drive mechanisms and the print head of this apparatus. That is, when various motors are initialized and head information is read, it is checked whether the apparatus is normally operable.

Next, steps S4 waits for an event. That is, this step monitors a demand event from the external I/F, a panel key event from the user operation and an internal control event and, when any of these events occurs, executes the corresponding processing.

When, for example, step S4 receives a print command event from the external I/F, the processing moves to step S5. When a power key event from the user operation occurs at step S4, the processing moves to step S10. If another event occurs, the processing moves to step S1.

Step S5 analyzes the print command from the external I/F, checks a specified paper kind, paper size, print quality, paper feeding method and others, and stores data representing the check result into the DRAM E2005 of the apparatus before proceeding to step S6.

Next, step S6 starts feeding the paper according to the paper feeding method specified by the step S5 until the paper is situated at the print start position. The processing moves to step S7.

At step S7 the printing operation is performed. In this printing operation, the print data sent from the external I/F is stored temporarily in the print buffer. Then, the CR motor E0001 is started to move the carriage M4001 in the main-scanning direction. At the same time, the print data stored in the print buffer E2014 is transferred to the print head H1001 to print one line. When one line of the print data has been printed, the LF motor E0002 is driven to rotate the LF roller M3001 to transport the paper in the sub-scanning direction. After this, the above operation is executed repetitively until one page of the print data from the external I/F is completely printed, at which time the processing moves to step S8.

At step S8, the LF motor E0002 is driven to rotate the paper discharge roller M2003 to feed the paper until it is decided that the paper is completely fed out of the apparatus, at which time the paper is completely discharged onto the paper discharge tray M1004.

Next at step S9, it is checked whether all the pages that need to be printed have been printed and if there are pages that remain to be printed, the processing returns to step S5 and the steps S5 to S9 are repeated. When all the pages that need to be printed have been printed, the print operation is ended and the processing moves to step S4 waiting for the next event.

Step S10 performs the printing termination processing to stop the operation of the apparatus. That is, to turn off various motors and print head, this step renders the apparatus ready to be cut off from power supply and then turns off power, before moving to step S4 waiting for the next event.

Step S11 performs other event processing. For example, this step performs processing corresponding to the ejection performance recovery command from various panel keys or external I/F and the ejection performance recovery event that occurs internally. After the recovery processing is finished, the printer operation moves to step S4 waiting for the next event.

II. CHARACTERISTIC CONFIGURATION

First Embodiment

Next, an principal part of a first embodiment of the present invention will be described.

First, the configuration of the tube pump M5100 will be explained.

The tube pump M5100 is connected to the cap M5001 via the pump tube M5019 and the cap tube M5009, as described above. The pump M5100 is connected to the PG motor E0003 via drive path switching means for switching a transmission path for a driving force between the automatic sheet feed unit M3022 and the pump M5100 and via a pump drive transmission gear train M5130.

Figure 19:
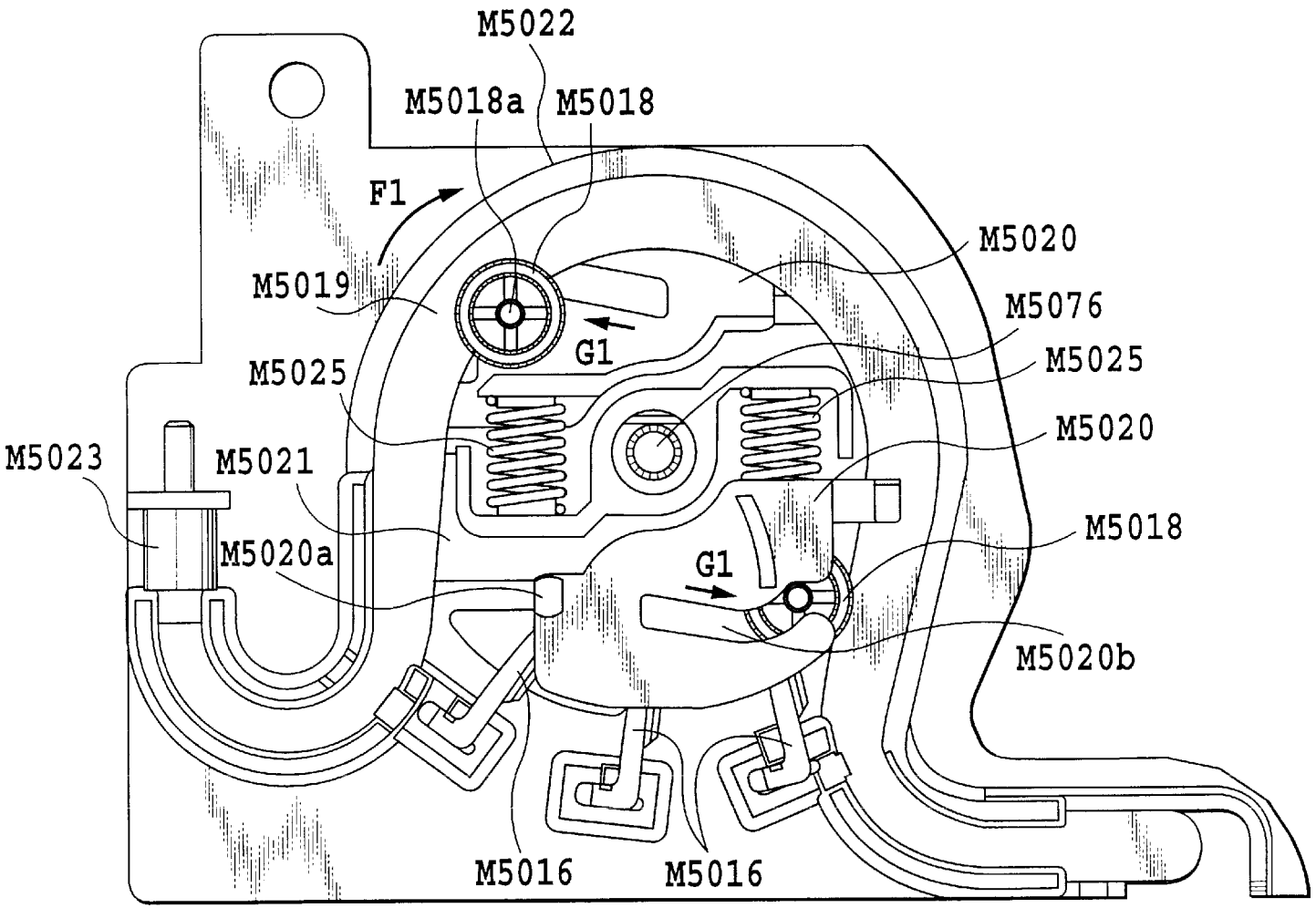
FIG. 19 is a sectional view showing an example of an internal configuration of a pump tube.
Figure 20:
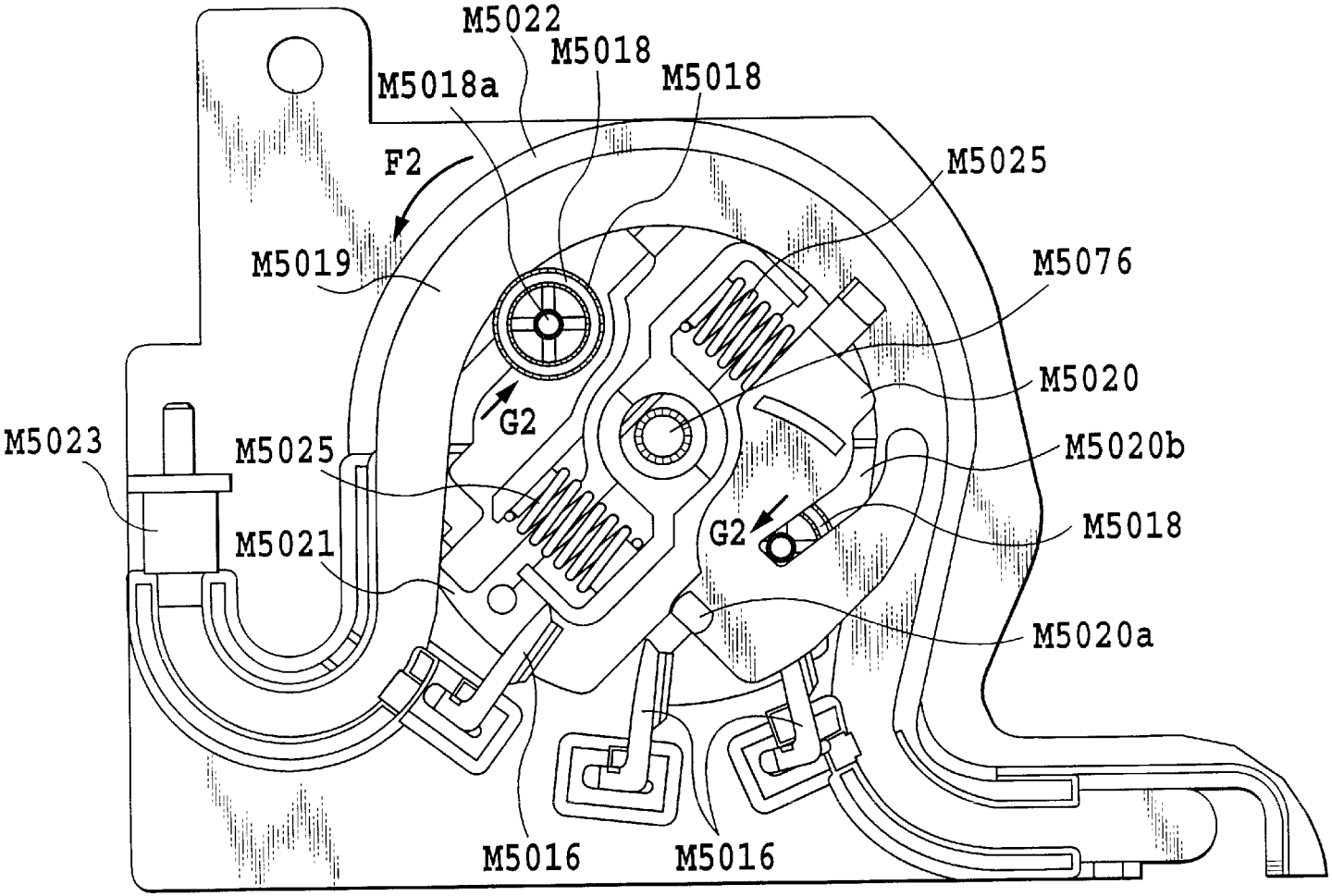
FIG. 20 is a sectional view showing an example of an internal configuration of a pump tube.

The tube pump M5100 uses the pump roller M5018 to squeeze the pump tube M5019 to generate pressure. The configuration of the tube pump M5100 is shown in FIGS. 19 and 20. FIG. 19 shows how the pump roller is brought into pressure contact with the pump tube M5019. FIG. 20 shows how the pump roller M5018 is released from the pressure contact with the pump tube M5019.

The pump M5100 comprises a pump tube M5109, a pump tube guide M5022 having an inner wall shaped like a semicylinder (180° or larger) around a pump center shaft M5076 and locating the pump tube M5019 along the inner wall, a pump roller M5018 that brings the pump tube M5019 into pressure contact with the pump tube guide M5022 to squeeze the pump tube M5019 in order to generate pressure, a pump roller holder M5020 for rotatably and movably supporting the pump roller M5018, a pump roller guide M5021 for rotatably supporting the pump roller holder M5020 on a rotating shaft M5020*a*, the pump roller guide M5021 being rotatably supported on a rotating shaft M5076, and a pump roller pressure contact spring M5025 for causing the pump roller M5018 to bring the pump tube M5019 into contact with the pump tube guide M5022.

In addition, two pump rollers M5018, two pump roller holders M502, and two pump roller contact pressure springs M5025 are provided on the pump roller guide M5021 in such a manner that each pair has an angular phase difference of 180°.

Additionally, the pump M5100 has a mechanism for releasing the pressure contact force of the pump roller M5018 on the pump tube M5019. The pump rollers M5018 are each configured so that its shaft moves through a movement groove M5020*b* formed in the pump roller holder M5020.

In the state in FIG. 19, the positional relationship between the pump roller M5018 and the movement groove M5020*b* in the pump roller holder M5020 is such that there is a large distance between a pump center shaft 5076 and the pump roller M5018 and that the pump roller M5018 comes in pressure contact with the pump tube M5019 (brings inner walls of the tube into mutual tight contact).

In the state in FIG. 20, there is a small distance between the pump roller M5018 and the pump center shaft 5076, and the pump roller M5018 is not in contact pressure with the pump tube M5019.

When the PG motor E0003 rotates normally, each member of the pump M5100 rotates in an arrow F2 direction in FIG. 20 around the pump center shaft M5076. At this point, the pump roller M5018 moves relatively through the movement groove M5020*b* in the pump roller holder M5020 in an arrow G2 direction due to a frictional force effected between the pump roller M5018 and the pump tube M5019. Thus, when the PG motor E0003 rotates normally, the pressure contact force of the pump roller M5018 is released to effect no suction pressure.

When the PG motor E0003 rotates in the reverse direction, each member of the pump M5100 rotates in an arrow F1 direction in FIG. 19 around the pump center shaft M5076. At this point, when passing through a roller damper M5016, the pump roller M5018 moves relatively through the movement groove M5020*b* in the pump roller holder M5020 in an arrow G1 direction due to an urging force of the roller damper M5016. Accordingly, when the PG motor E0003 rotates reversely, the pump roller M5018 applies the pressure contact force to enable the pump tube M5019 to be squeezed to generate a suction pressure.

Figure 21:
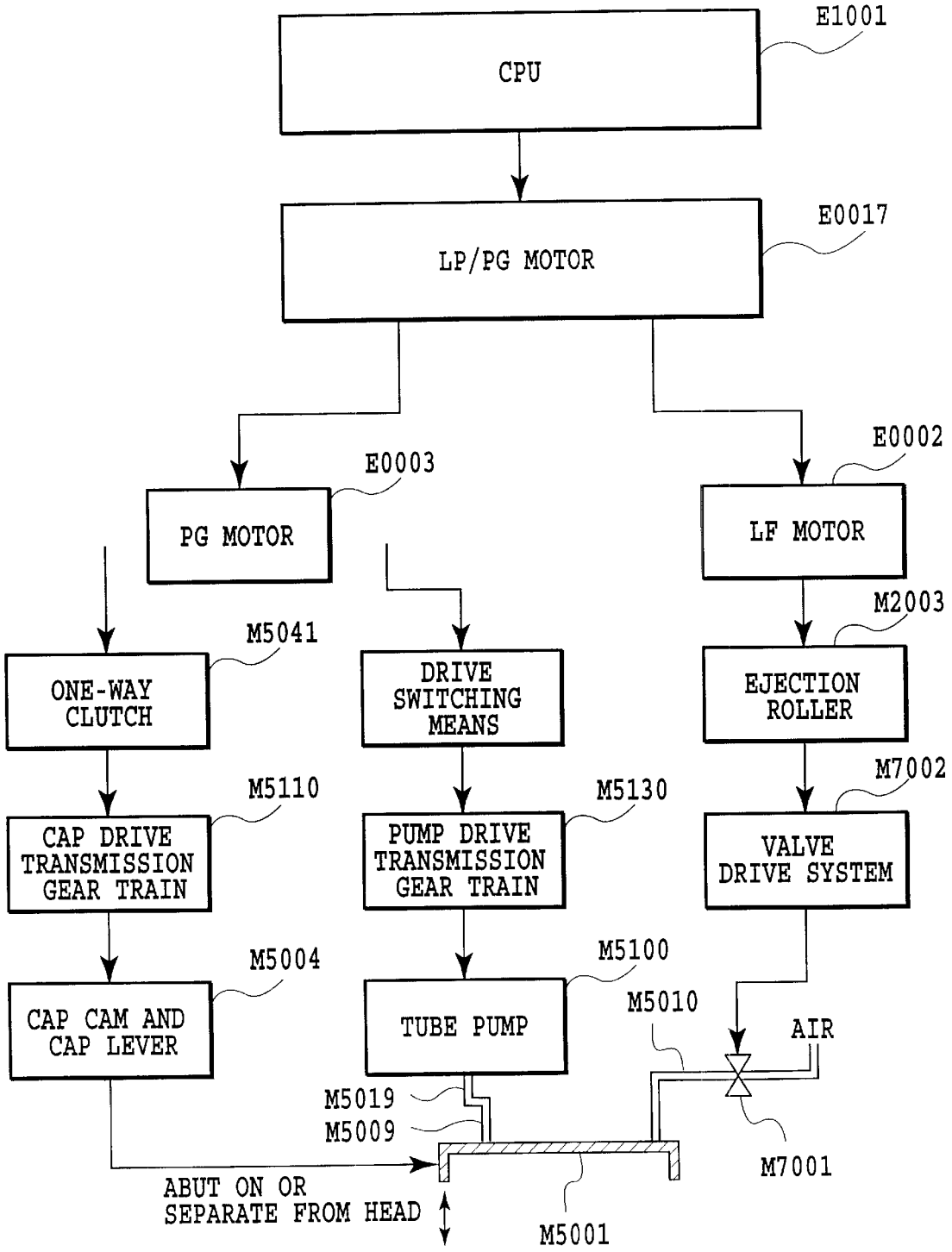
FIG. 21 is a conceptual block diagram showing a general configuration of a control and drive systems for a suction recovery process.

FIG. 21 is a conceptual block diagram showing a general configuration of a control and drive systems for a suction recovery process.

The CPU E1001 drives and controls the PG motor E0003 and an LF motor E0002 via an LP/PG motor drive E0017.

The PG motor E0003 has one shaft connected to the cap M5001 via a one-way clutch M5041, a cap drive transmission gear train M5110, and a cap cam and cap lever M5004. When the PG motor E0003 rotates normally, the cap M5001 is brought in tight contact and abutment with the print element substrate H1100 of the print head H1001.

The PG motor E0003 has the other shaft connected to the rotating shaft M5076 of the tube pump M5100 via drive path switching means comprising the pendulum arm M5026 and the selector lever M5043 and via the pump drive transmission gear train M5130. As described above, the tube pump M5100 can generate a suction pressure when the PG motor E0003 rotates reversely, but cannot when the PG motor E0003 rotates normally.

The LF motor E0002 rotatively drives the ejection rollers M2003. The ejection rollers M2003 is connected to an air communication valve M7001 via a valve drive system M7002 comprising the valve drive transmission gear train M5140, the valve clutch M5048, the valve rubber M5036, and the like. The air communication valve M7001 opens and closes the valve tube M5010 relative to the air and comprises the above described valve lever M5038 and valve rubber M5036. When the LF motor E0002 is reversed and the ejection rollers M2003 are driven in the reverse direction, the air communication valve M7001 is opened. When the LF motor E0002 is normally rotated and the ejection rollers M2003 are driven in the normal direction, the air communication valve M7001 is closed.

Figure 22:
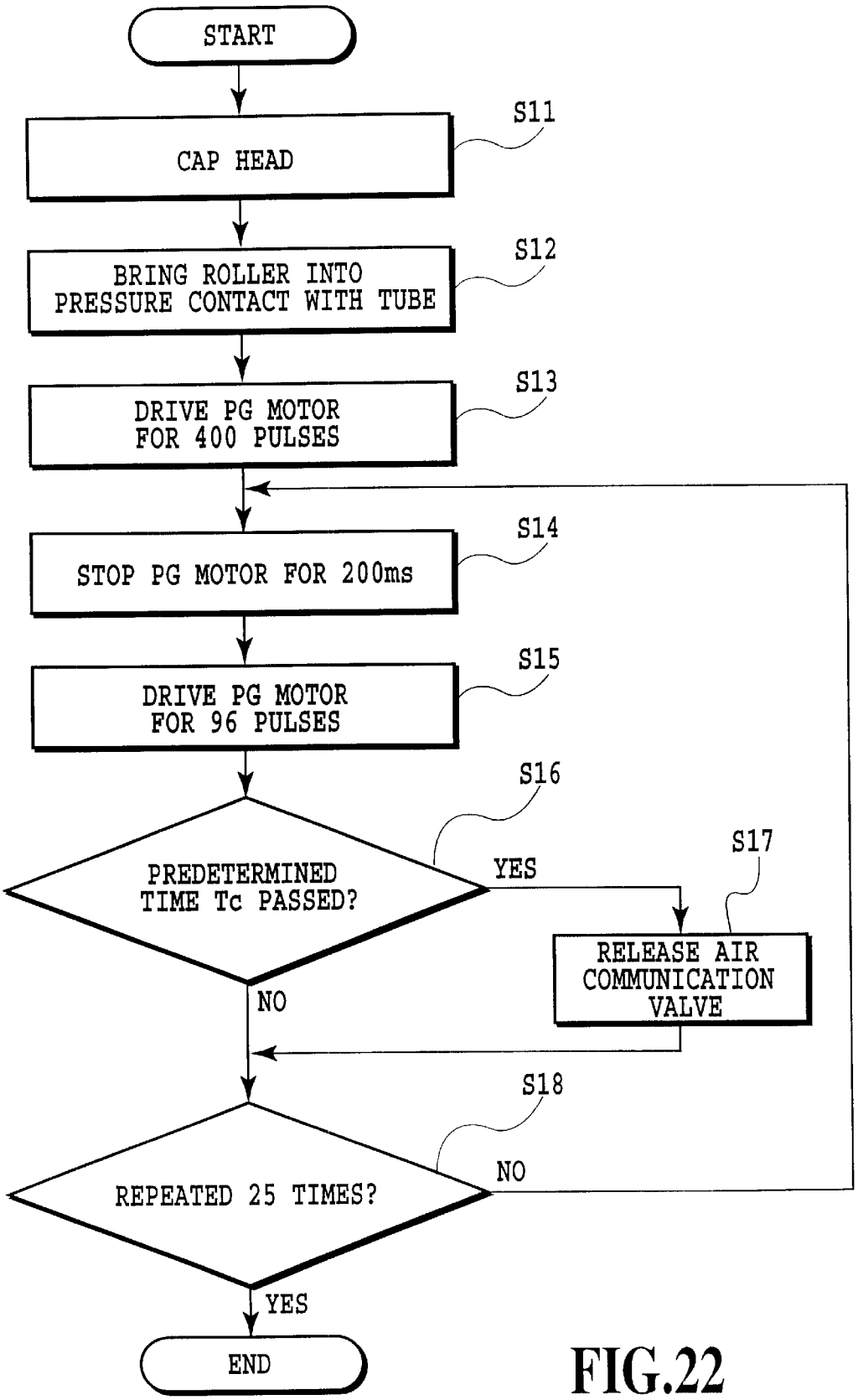
FIG. 22 is a flow chart showing an operational sequence of suction recovery according to a first embodiment of the present invention.

Next, an operational sequence of suction recovery according to the first embodiment will be described with reference to the flow chart shown in FIG. 22.

In the following description, the PG motor E0003, which is a pulse motor, rotates the pump roller M5018 once around the rotating shaft M5076 with 478 pulses of command pulse signals.

First, the CPU E1001 normally rotates the PG motor E0003 to drive the cap cam and cap lever M5004, thereby moving the cap M5001 to the print element substrate H1100 (the head face) of the print head H1001 to cap the head face (step S11). At this point, the normal rotation of the PG motor E0003 causes the tube pump M5100 to move. Since, however, the pressure contact force of the pump roller M5018 on the pump tube M5019 has been released, the pump roller M5018 does not squeeze the pump tube M5019 with no suction pressure generated.

In this state, the air communication valve M7001 has been opened.

Next, the CPU E1001 drives the LF motor E0002 to drive the ejection rollers M2003 in the normal direction to close the air communication valve 7001. Furthermore, the CPU E1001 reversely drives the PG motor E0003 at a predetermined rotation speed for a predetermined number of pulses to bring the pump roller M5018 into pressure contact with the pump tube M5019 to thereby squeeze the pump tube M5019 until the pressure inside the cap reaches a predetermined target negative pressure (steps S12, S13). For example, the PG motor E0003 is driven at a rotation speed of 700 PPS for 400 pulses. As a result, the pressure contact force of the pump roller M5018 squeezes the pump tube M5019 to effect a negative pressure on the print element substrate H1100 of the print head cartridge H100 via the cap tube M5009 and the cap M5001, whereby inks that are no longer suitable for printing as well as bubbles are forcibly sucked through the ejection port on the print element substrate H1100.

When the motor is driven at a rotation speed of 700 PPS for 400 pulses as described above, the negative pressure rises up to a target value, for example, 0.19 atm.

Once the CPU E1001 has completed driving the motor for 400 pulses, the PG motor E0003 is stopped for a preset predetermined period of time td, for example, 200 ms (step S14). During this stoppage, when the ink sucked through the ejection port on the print element substrate H1100 due to the negative pressure inside the cap M5001 flows into the pump tube M5019, the negative pressure inside the cap falls by an amount corresponding to the volume of the flown-in ink because the tube pump M5100 is stopped. The amount of the decrease in negative pressure during the stoppage of the pump is, for example, 0.02 atm.

After a predetermined time td of standby, the CPU E1001 reversely drives the PG motor E0003 at a predetermined rotation speed for a predetermined number of command pulses (a predetermined amount of driving). For example, the PG motor E0003 is driven at a rotation speed of 700 PPS for 96 pulses (step S15).

When the PG motor E0003 is redriven in this manner, the negative pressure rises again by an amount almost equal to the above described fall (for example, 0.02 atm). By repeating the stopping and driving of the PG motor in this manner, a negative pressure close to a target value (for example, 0.17 to 0.10 atm) can be continuously applied to the cap M5001.

Next, the CPU E1001 determines at step S13 whether or not an elapsed time T from the start of driving of the PG motor E0003 till the current point of time has exceeded a predetermined value Tc (for example, 1.5 seconds) (step S16). If a result of the determination shows that the predetermined period of time Tc has not passed, then the CPU E1001 determines whether or not the number of times n that the processing in steps S14 and S15 has been repeated has reached a predetermined value nc (for example, 25) (step S18). If the predetermined value has not been reached, the procedure returns to step S14 to repeat the processing in steps S14 and S15.

Alternatively, If the result of the determination shows that the elapsed time T has reached the predetermined value Tc, the CPU E1001 normally rotates the LF motor E0002 to drive the ejection rollers M2003 in the normal direction to open the air communication valve M7001 (step S17). When the air communication valve M7001 is opened, the interior of the cap M5001 is set at the atmospheric pressure to complete the suction of the ink from the print head H1001.

The set period of time Tc and the set number of times nc are desirably adjusted so that the air communication valve M7001 is opened while the PG motor E0003 is being driven. When the air communication valve M7001 is opened while the PG motor E0003 is being driven, the ink in the cap M5001 which has been sucked from the print head H1001 can be removed quickly from the cap M5001. Thus, the amount of ink remaining on the head face can be reduced to effectively prevent mixture of colors. The amount of suction according to this embodiment is determined by the elapsed time Tc from the start of driving of the PG motor at step S13 until the air communication valve M7001 is released.

Even after the air communication valve M7001 has been opened, the driving and stopping (wait) of the PG motor E0003 is repeated until the number of repetitions n reaches the predetermined value nc.

That is, even after the air communication valve M7001 has been opened, the driving and stopping of the PG motor E0003 is repeated until the number of repetitions n reaches the predetermined value nc, thereby allowing the ink remaining in the tubes M5009, M5019 of the printer recovery apparatus to be ejected into a waste ink absorbent provided in the printer main body (this operation is called "evacuation").

To reduce the initial volume for suction in order to improve pump efficiency, the tubes of the printer recovery apparatus are often made as thin as possible. In this case, even if the air communication valve M7001 is open, the flow resistance of the tubes causes a minor negative pressure to be generated in the cap during the evacuation. When this negative pressure exceeds a certain value specific to the head, the ink may be drawn out from the head to cause color mixture or the like.

Thus, in this apparatus, the driving and stopping of the PG motor E0003 is repeated even during the evacuation to minimize the occurrence of a negative pressure inside the cap, thereby preferably avoiding troubles such as color mixture.

As described above, in the first embodiment, after the tube pump is continuously rotated to quickly set the interior of the cap at the target negative pressure, the driving and stopping of the tube pump is repeated a number of times to maintain the interior of the cap at a pressure within the predetermined range close to the target negative pressure. Consequently, suction can be carried out without excessively increasing the suction pressure. Therefore, the suction can be recovered with an appropriate amount of suction and an appropriate suction pressure for the print head to restrain the wasteful use of the ink while preventing bubbles from being sucked.

In the above described embodiment, the driving speed and the number of command pulses are specified for the PG motor E0003 to set the driving of the tube pump at steps S13 and S15, but the driving of the tube pump may be set using the driving speed and time for the motor. In addition, in the above embodiment, the PG motor is driven for 96 pulses and stopped for 200 ms, but these parameters can be controlled in more detail to maintain the pressure inside the cap within a smaller range.

In addition, in this embodiment, the number of drive pulses for the PG motor is fixed at 96 and the wait time is fixed at 200 ms for the repetition of driving and waiting steps for the PG motor between S14 and S15, but these values may be changed during the repetition. For example, if the ink near the nozzle grows more viscous when the print head is left over time, the ink of an increased viscosity near the nozzle is not ejected easily due to its degraded fluidity, whereas the ink in the head channel, which has not grown more viscous, can be ejected relatively easily. In this case, by repeating the driving and waiting steps for the PG motor, the PG motor can be driven more powerfully only during initial suction. For example, by setting the first number of drive pulses at 154, the second number of drive pulses at 134, the third number of drive pulses at 115, and the fourth number of drive pulses at 96 with the wait time fixed at 200 ms, the initial suction can be made more powerful to quickly eject the ink of the increased viscosity. Of course, similar effects are obtained by varying the wait time with the number of drive pulses fixed during the repetition of the driving and waiting steps for the PG motor or varying both the drive pulse and the wait time. The suction method according to the present invention is desirably optimized depending on the conditions of the head and the type of the ink.

The above described method for repeating driving and stopping the tube pump during the suction is particularly effective on print heads with small ejection ports (for example, the area of the ejection port is between about 280 and 330 $\mu m^2$). The reason is shown below. The small ejection port has a relatively high flow resistance to preclude an increase in the ink flow rate and thus requires a larger amount of time for recovery than larger ejection ports. Accordingly, the recovery requires a relatively high suction pressure to be applied for a long time, resulting in the above described technical problems (bubbles from the tank may be mixed into the liquid chamber or the ink may be wasted). In the above described embodiment, 330 $\mu m^2$ ejection ports were used by way of example and appropriate recovery effects were obtained.

Second Embodiment

Figure 23:
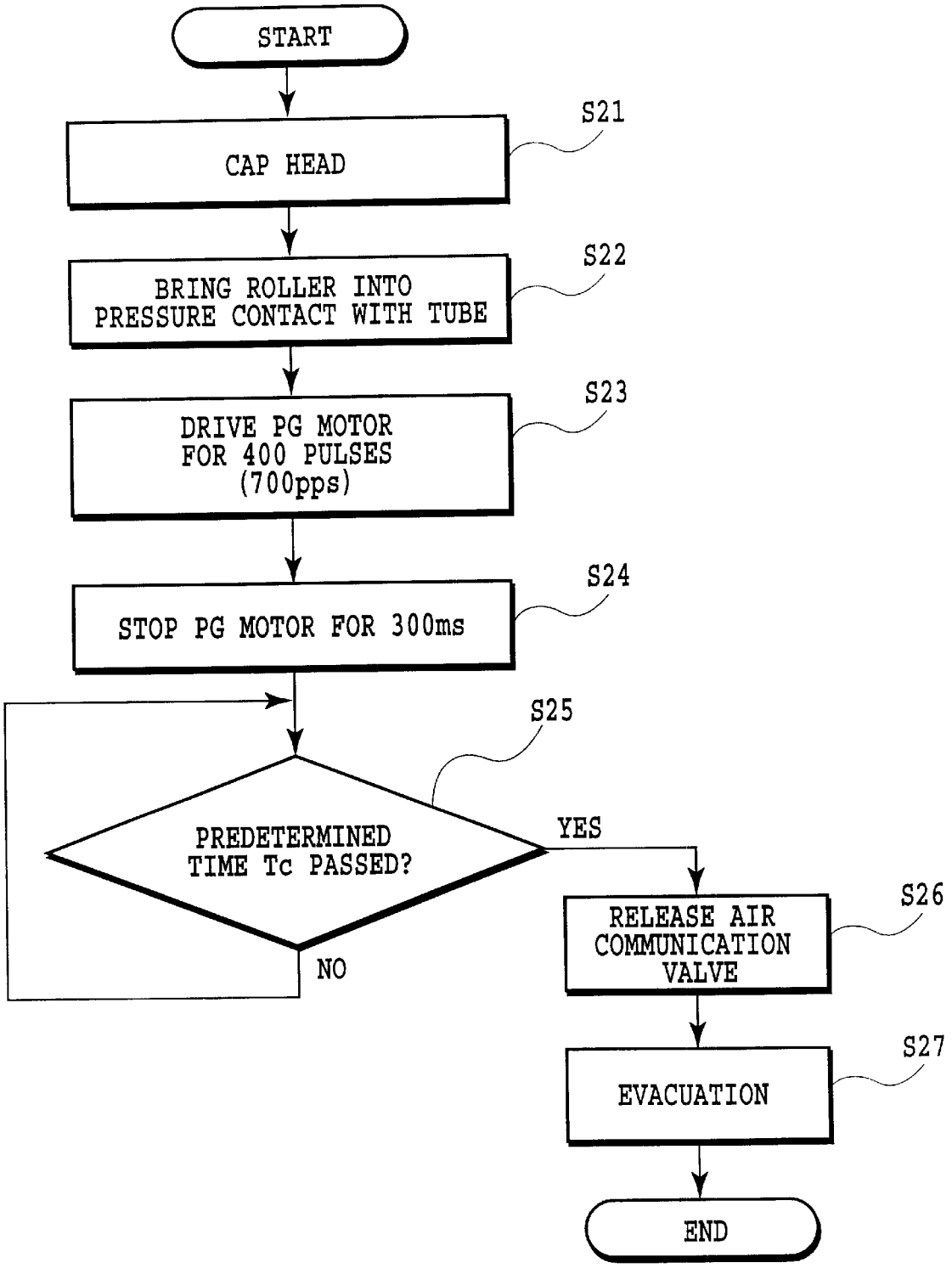
FIG. 23 is a flow chart showing an operational sequence of suction recovery according to a second embodiment of the present invention.

Next, an operational sequence of suction recovery according to a second embodiment of the present invention will be explained with reference to the flow chart shown in FIG. 23.

First, the CPU E1001 normally rotates the PG motor E0003 to drive the cap cam and cap lever M5004 to cap the head face of the print head H1001 (step S21). In this state, the air communication valve M7001 has been opened. Next, the CPU E1001 drives the LF motor E0002 to drive the ejection rollers M2003 in the normal direction to close the air communication valve 7001. Furthermore, the CPU E1001 reversely drives the PG motor E0003 at a predetermined rotation speed for a predetermined number of pulses to bring the pump roller M5018 into pressure contact with the pump tube M5019 to thereby squeeze the pump tube M5019 until the pressure inside the cap reaches a predetermined target negative pressure (steps S22, S23). For example, the PG motor E0003 is driven at a rotation speed of 700 PPS for 400 pulses. As a result, the pressure contact force of the pump roller M5018 squeezes the pump tube M5019 to effect a negative pressure on the print element substrate H1100 of the print head cartridge H100 via the cap tube M5009 and the cap M5001, whereby inks that are no longer suitable for printing as well as bubbles are forcibly sucked through the ejection port on the print element substrate H1100.

When the motor is driven at a rotation speed of 700 PPS for 400 pulses as described above, the negative pressure rises up to a target value, for example, 0.19 atm.

Once the CPU E1001 has completed driving the motor at a rotation speed of 700 PPS for 400 pulses, it reduced the rotation speed down to 300 PPS to drive the PG motor E0003 at this rotation speed (step S24).

Figure 24:
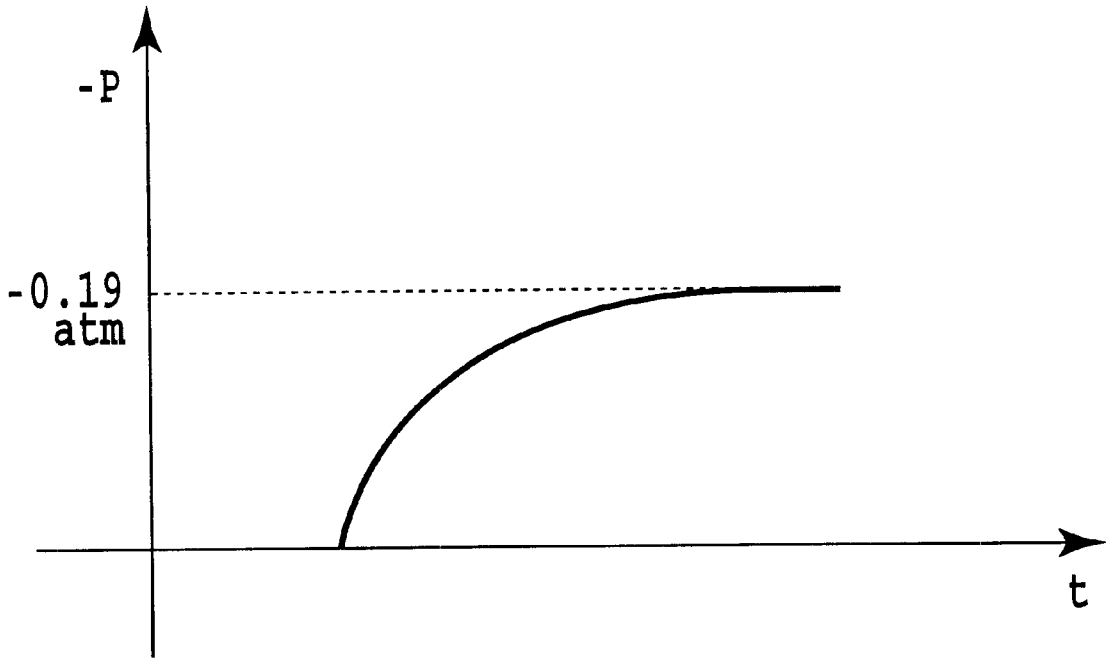
FIG. 24 is a chart showing a waveform of a negative pressure during driving at a low speed according to the second embodiment.
Figure 25:
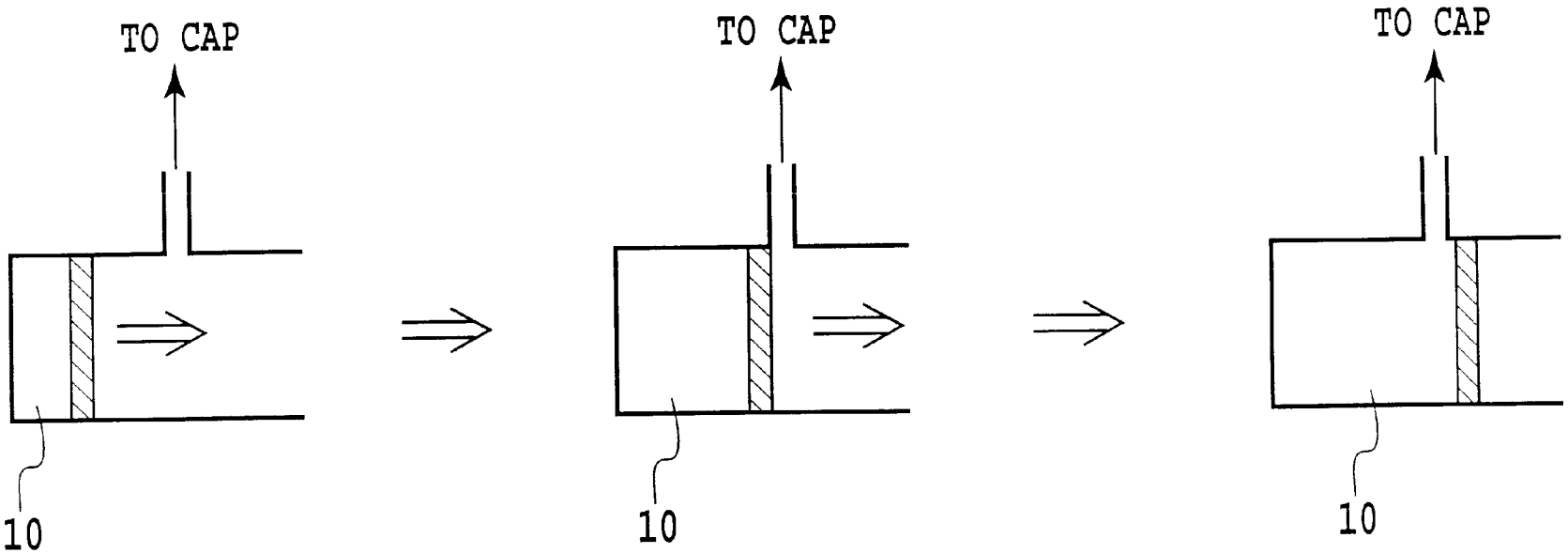
FIG. 25 is a schematic view showing a principle of a piston pump.
Figure 26:
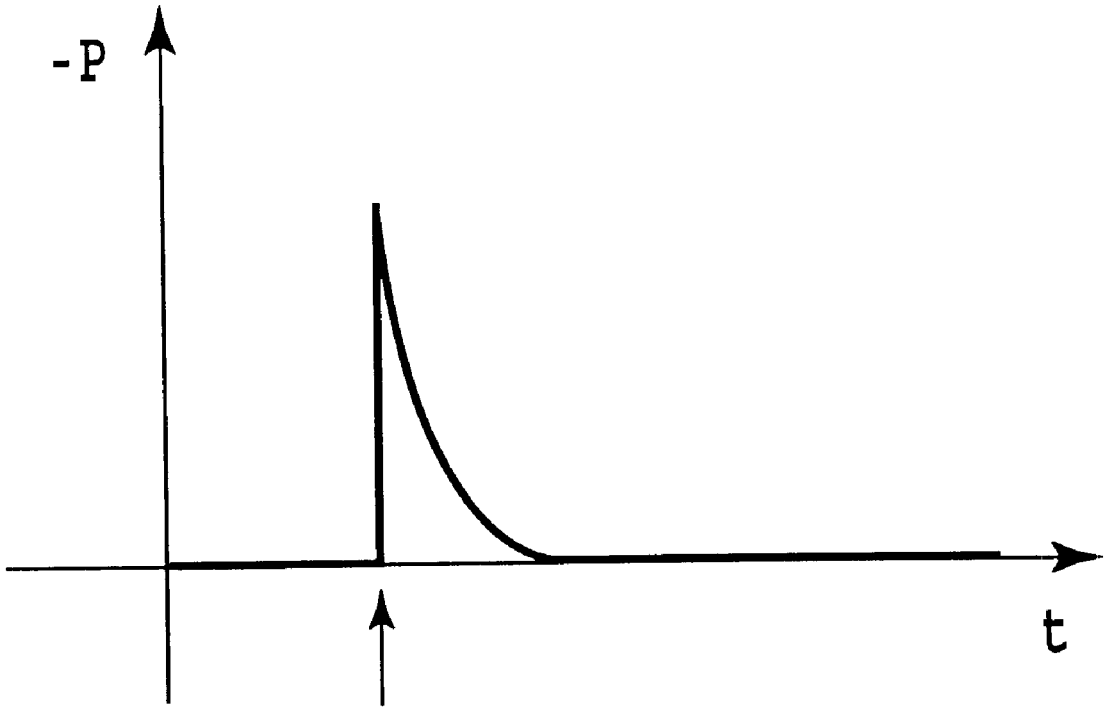
FIG. 26 is a chart showing a waveform of a negative pressure observed when the piston pump is used for suction recovery.
Figure 27:
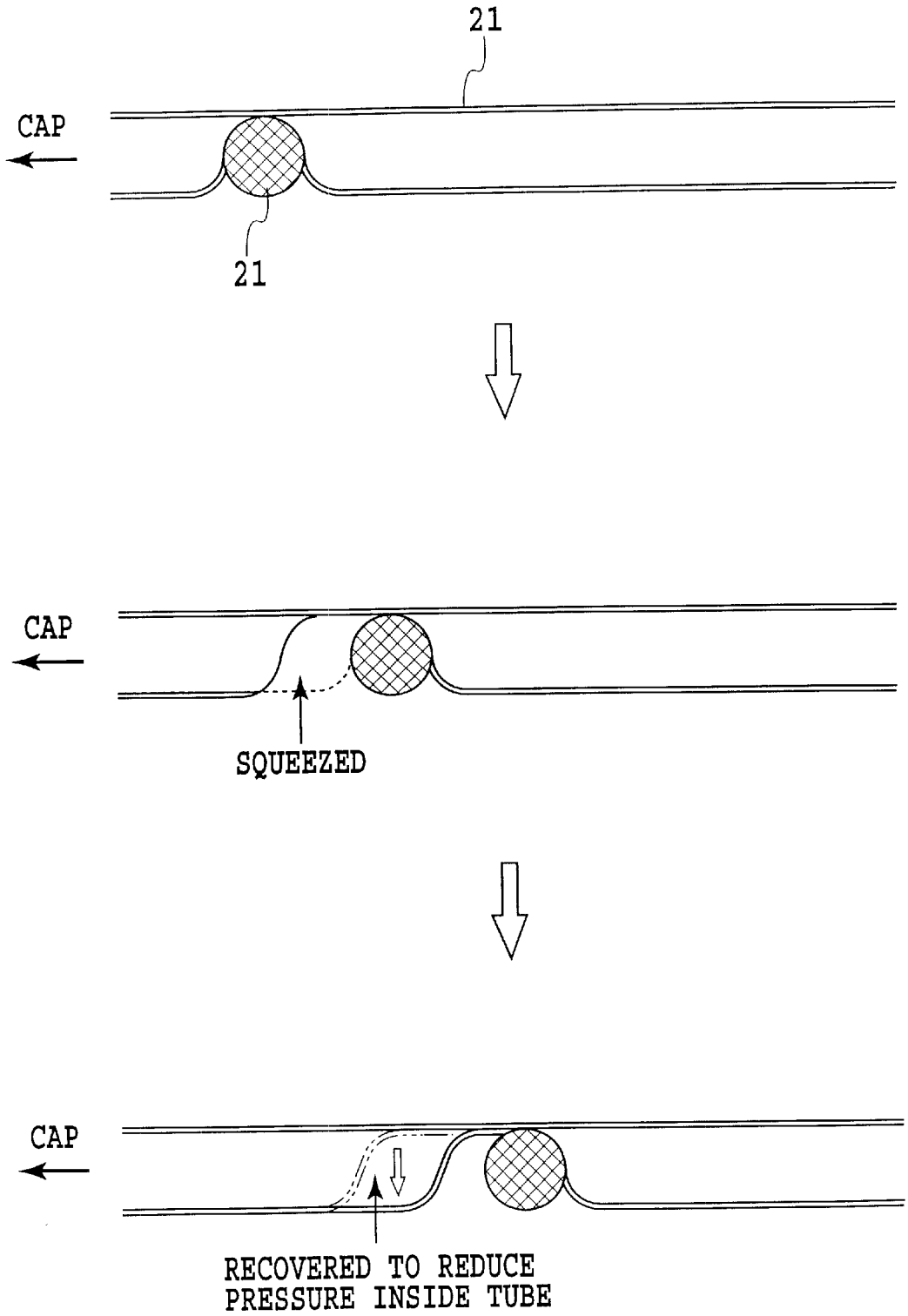
FIG. 27 is a schematic view showing a principle of a tube pump.
Figure 28:
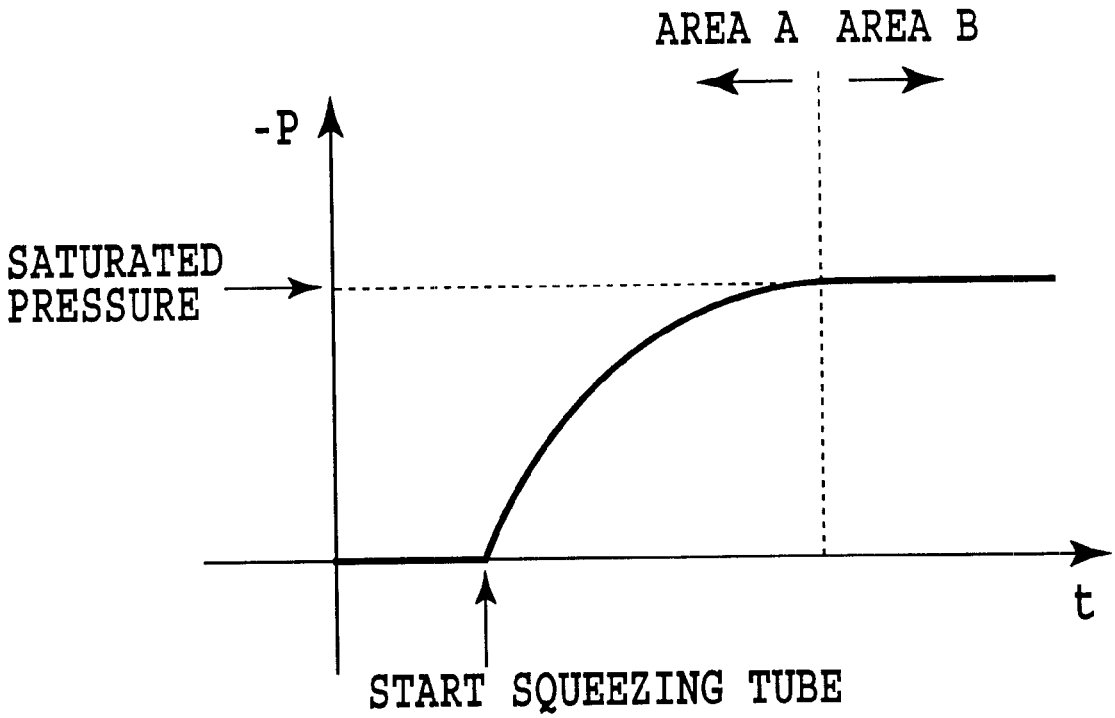
FIG. 28 is a chart showing a waveform of a negative pressure observed when the tube pump is used for suction recovery.

A negative suction pressure generated if the PG motor E0003 is driven at 300 PPS is shown in FIG. 24. As is apparent from FIG. 24, when the pump is driven at 300 PPS, cancellation of the negative pressure effected by the ink drawn out from the head and the negative pressure generated by the driven pump are balanced at 0.19 atm.

As described above, in the second embodiment, the target negative pressure can be continuously applied by continuously driving the motor at the first predetermined rotation speed (in this case, 700 PPS) to quickly set the interior of the cap at the target negative pressure and then driving the motor at the second rotation speed (in this case, 300 PPS) lower than the first one.

The driving of the motor at the second speed is completed when the elapsed time T from the start of driving of the PG motor E0003 exceeds the predetermined value Tc (for example, 1.5 seconds) at step S23. That is, the CPU E1001 determines whether or not the elapsed time T has exceeded the predetermined value Tc (for example, 1.5 seconds) (step S26). On detecting that the elapsed time T has reached the predetermined value Tc, then the CPU E1001 normally rotates the LF motor E0002 to drive the ejection rollers M2003 in the normal direction to release the air communication valve M7001 (step S26). When the air communication valve M7001 is released, the interior of the cap M5001 is set at the atmospheric pressure to complete the suction of the ink from the print head H1001.

At step S26, the air communication valve M7001 is opened while the PG motor E0003 is being driven as in the first embodiment, whereby the ink sucked from the head and remaining in the cap can be removed from the cap quickly. The amount of suction according to this embodiment is determined by the elapsed time Tc from the start of driving of the PG motor E0003 at step S23 until the air communication valve M7001 is released.

Even after the air communication valve M7001 has been opened, the PG motor E0003 is continuously driven for a predetermined number of command pulses (for example, 1,000 pulses) or a predetermined period of time to execute the evacuation, thereby allowing the ink remaining in the cap and tube of the recovery apparatus to be ejected into the waste ink absorbent. Then, the PG motor E0003 is stopped (step S27).

As described above, in the second embodiment, the tube pump is continuously driven at the predetermined driving speed to quickly set the interior of the cap at the target negative pressure and the driving speed is then reduced. Consequently, the negative pressure generated by the pump and the cancellation of the negative pressure caused by the ink suction are balanced at the target negative pressure. As a result, the suction can be recovered with an appropriate amount of suction and an appropriate suction pressure for the print head to restrain the wasteful use of the ink while preventing bubbles from being sucked.

This method according the second embodiment can be effectively used particularly for suction recovery operations for print heads with small ejection ports.

The configuration of the pump tube, the configuration for the contact and separation of the cap with and from the print head, the configuration for opening and closing the air communication valve M7001, and other configurations shown in the above described embodiments may be substituted with other arbitrary corresponding configurations only if they can provide functions similar to those shown in the embodiments.

The present invention can be effectively used in an aspect where thermal energy generated by an thermoelectric converter is used to cause film boiling in the liquid to form bubbles.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A suction recovery method for an ink jet printing apparatus for driving a tube pump connected to a cap while a face of a print head is capped by the cap, to generate a negative pressure inside the cap to suck an ink from said print head, the method comprising:

a step of continuously driving the tube pump until a pressure of an interior of the cap becomes a first negative pressure; and a step of repeating an operation for a number of times which stops said tube pump until the pressure of the interior of the cap becomes a second negative pressure having a smaller absolute value than said first negative pressure and drives said tube pump again until the pressure of the interior of the cap becomes said first negative pressure.

2. A suction recovery method for an ink jet printing apparatus according to claim 1, wherein when a preset predetermined period of time has passed since the continuous driving of the tube pump was started, an interior of said cap is exposed to atmosphere.

3. A suction recovery method for an ink jet printing apparatus according to claim 2, wherein stopping and driving of said tube pump is repeated a number of times even after the interior of the cap has been exposed to the atmosphere.

4. A suction recovery method for an ink jet printing apparatus according to claim 1, wherein said print head has a thermoelectric converter for generating thermal energy to cause film boiling in the ink, as an element for generating energy for use in ejecting the ink.

5. An ink jet printing apparatus for driving a tube pump connected to a cap while a face of a print head is capped by the cap, to generate a negative pressure inside the cap to suck an ink from said print head, the apparatus comprising:

control means for continuously driving the tube pump until a pressure of an interior of the cap becomes a first negative pressure and repeating an operation for a number of times which stops said tube pump until the pressure of the interior of the cap becomes a second negative pressure having a smaller absolute value than said first negative pressure and drives said tube pump again until the pressure of the interior of the cap becomes said first negative pressure.

6. An ink jet printing apparatus according to claim 5, wherein when a preset predetermined period of time has passed since the continuous driving of the tube pump was started, said control means exposes an interior of said cap to atmosphere.

7. An ink jet printing apparatus according to claim 6, wherein said control means repeats stopping and driving said tube pump a number of times even after the interior of the cap has been exposed to the atmosphere.

8. An ink jet printing apparatus according to claim 5, wherein said print head has a thermoelectric converter for generating thermal energy to cause film boiling in the ink, as an element for generating energy for use in ejecting the ink.

* * * * *

UNITED STATES PATENT AND TRADEMARK OFFICE

CERTIFICATE OF CORRECTION

PATENT NO. : 6,631,973 B1
DATED : October 14, 2003
INVENTOR(S) : Edamura

It is certified that error appears in the above-identified patent and that said Letters Patent is hereby corrected as shown below:

Column 2,
Line 9, “trouble.” should read -- problem. --.
Line 62, “above described” should read -- above-described --.

Column 3,
Line 6, “tub” should read -- tube --.

Column 5,
Line 19, “word” should read -- terms --.
Line 22, “ink. This word will” should read -- ink, and can --.
Line 23, ““paper”.” should read -- as “paper”. --.

Column 6,
Line 10, “and so on” should read -- or the like --.

Column 12,
Line 10, “unit 5000” should read -- unit M5000 --.

Column 14,
Line 19, “locked” should read -- locked and --.
Line 40, “foams” should read -- foam --.

Column 15,
Line 62, “about” should be deleted.

Column 18,
Line 40 “E001O,” should read -- E0010, --.

Column 19,
Line 41, “receive” (both occurrences) should read -- received --.
Line 52, “receive” should read -- received --.

Column 21,
Line 56, “S1.” should read -- S11. --.

Column 22,
Line 40, “an” should read -- a --.

UNITED STATES PATENT AND TRADEMARK OFFICE

CERTIFICATE OF CORRECTION

PATENT NO. : 6,631,973 B1
DATED : October 14, 2003
INVENTOR(S) : Edamura

It is certified that error appears in the above-identified patent and that said Letters Patent is hereby corrected as shown below:

Column 23,
Line 8, “M502,” should read -- M5020, --.
Line 27, “shaft 5076,” should read -- shaft M5076, --.

Column 24,
Line 5, “is” should read -- are --.
Line 11, “above described” should read -- above-described --.
Line 39, “valve 7001.” should read -- valve M7001. --.

Column 25,
Line 11, “above described” should read -- above-described --.
Line 26, “If” should read -- if --

Column 26,
Lines 16, 49 and 60, “above described’ should read -- above-described --.
Line 20, “In” should begin a new paragraph.
Line 57, “above” should read -- above- --.

Column 27,
Line 4, “Next” should begin a new paragraph.
Line 7, “valve 7001.” should read -- valve M7OO1. --.
Line 27, “reduced” should read -- reduces --.

Column 28,
Line 25, “above described” should read -- above-described --.

Signed and Sealed this

Third Day of August, 2004

JON W. DUDAS
*Acting Director of the United States Patent and Trademark Office*